US012722747B2

(12) United States Patent
Brown et al.

(10) Patent No.: US 12,722,747 B2
(45) Date of Patent: Sep. 1, 2026

(54) ENTERTAINMENT UNIT MOUNTING SYSTEM

(71) Applicant: Teak Isle Manufacturing, Inc., Ocoee, FL (US)

(72) Inventors: Patrick Brown, Longwood, FL (US); Sean Ciervo, Minneola, FL (US); Troy Roop, Apopka, FL (US)

(73) Assignee: Teak Isle Manufacturing, Inc., Ocoee, FL (US)

( * ) Notice: Subject to any disclaimer, the term of this patent is extended or adjusted under 35 U.S.C. 154(b) by 513 days.

(21) Appl. No.: 18/232,420

(22) Filed: Aug. 10, 2023

(65) Prior Publication Data

US 2025/0050980 A1 Feb. 13, 2025

(51) Int. Cl.

| | |
|---|---|
| ***B63B 35/34*** | (2006.01) |
| ***B63B 25/00*** | (2006.01) |
| ***B63B 25/28*** | (2006.01) |
| ***B63B 29/04*** | (2006.01) |
| ***B63B 35/40*** | (2006.01) |
| ***B63B 35/613*** | (2006.01) |

(52) U.S. Cl.

CPC ..... *B63B 25/004* (2013.01); *B63B 25/28* (2013.01); *B63B 29/04* (2013.01); *B63B 35/34* (2013.01); *B63B 35/40* (2013.01); *B63B 35/613* (2013.01); *B63B 2029/046* (2013.01)

(58) Field of Classification Search

CPC ..... B63B 25/004; B63B 25/28; B63B 29/04; B63B 35/34; B63B 35/40

See application file for complete search history.

(56) References Cited

U.S. PATENT DOCUMENTS

| | | | | | |
|---|---|---|---|---|---|
| 3,473,502 | A * | 10/1969 | Wittkamp | B63B 1/121 | 441/40 |
| 4,768,459 | A * | 9/1988 | Cerkvenik | A45F 3/15 | 114/364 |
| 6,050,210 | A * | 4/2000 | Grzybowski | B63B 43/14 | 114/123 |
| 7,490,802 | B1 * | 2/2009 | Teng | A47B 96/063 | 248/229.15 |
| 9,067,646 | B2 * | 6/2015 | Admire | B63B 35/34 | |
| 9,150,353 | B2 * | 10/2015 | Jackson | B65F 1/141 | |
| 9,663,197 | B2 * | 5/2017 | Bires | B63B 29/04 | |
| 10,046,712 | B1 * | 8/2018 | Foley | B60R 9/06 | |
| 2008/0042027 | A1 * | 2/2008 | LaScala | B63B 17/04 | 248/228.6 |
| 2011/0048311 | A1 * | 3/2011 | Hosey | B63B 25/28 | 114/344 |
| 2022/0297803 | A1 * | 9/2022 | Redburn | F16M 11/10 | |

* cited by examiner

*Primary Examiner* — Marc Q Jimenez
*Assistant Examiner* — Jovon E Hayes
(74) *Attorney, Agent, or Firm* — Taft, Stettinius & Hollister LLP

(57) ABSTRACT

The present invention broadly relates to a clamping system adapted to releasably couple an entertainment unit accessory. In an embodiment, the present invention is adapted to be mounted to a mounting surface, such as deck or under the deck of a boat. The clamping system allows for various entertainment unit accessories, such as tables, grills, and coolers, to be releasably coupled to the mounting surface. The clamping system also allows for the transport of various water toys such as kayaks, paddle boards, and water mats.

18 Claims, 29 Drawing Sheets

ENTERTAINMENT UNIT MOUNTING SYSTEM

TECHNICAL FIELD OF THE INVENTION

The present invention relates generally to accessory attachments adapted to be coupled to an outside of a boat, such as a pontoon.

BACKGROUND OF THE INVENTION

A popular past time for many boaters, particularly pontoon boaters, is taking a boat to a sand bar and anchoring the boat on the sand bar, and then swimming or otherwise being in the water adjacent to the boat. Shallow locations, such as a sand bar, offers a place for boaters to congregate and recreate, while enjoying the shallow water. However, when in the water, boaters do not have easy access to items such as coolers, grills, and serving trays as these items remain inside the boat. Repeatedly getting into and out of the boat to access these items is inconvenient, and it increases the risk of slipping and falling while doing so.

SUMMARY OF THE INVENTION

The present invention broadly relates to a mounting system to accommodate accessories such as coolers, grills, and serving trays, tables, umbrellas, and other accessories. The quick mounting system includes a clamping system that allows for easy and quick attachment and removal of accessories from the clamping system. The clamping system permits rotation of the accessory relative to the mounting surface, such as a boat, to provide an accessory in a substantially level position, even when the mounting surface is not level.

In an embodiment, the present invention broadly comprises a clamping system for retaining an accessory. The clamping system includes a clamping block adapted to couple to a mounting surface or a mounting block; a clamping member having a first end and a second end, wherein the first end is pivotably coupled to the clamping block; a fastener disposed on the clamping member proximal to the second end of the clamping member and adapted to engage the clamping block; and an assembly arm. The optional mounting block is adapted to couple to a mounting surface and the clamping block of the clamping system. When the fastener is engaged to the clamping block, the clamping block and the clamping member cooperatively define a substantially cylindrical opening for receiving the assembly arm.

In another embodiment, the present invention broadly comprises a clamping system for attachments. The clamping system includes a clamping block adapted to couple to a mounting surface or a mounting block; a clamping member pivotably coupled to the clamping block; a hole in the clamping member; an assembly arm having a first end with a hole and a second end; a support member coupled to the second end; and a pin engaged with the hole of the clamping member and the hole of the arm. When the fastener is engaged to the clamping block, the clamping block and the clamping member define a substantially cylindrical opening for receiving the assembly arm.

In another embodiment, the present application broadly comprises an entertainment unit adapted to be coupled to a mounting surface. The entertainment unit may include, for example, a table portion having a top side and a bottom side; and a lower portion coupled to the bottom side of the first portion by a support structure. The table portion may include apertures adapted to receive beverage containers, a gas tank relief cut-out adapted to receive a gas tank, and a grill retaining slot; and the lower portion is adapted to provide support for a beverage container positioned in an aperture.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
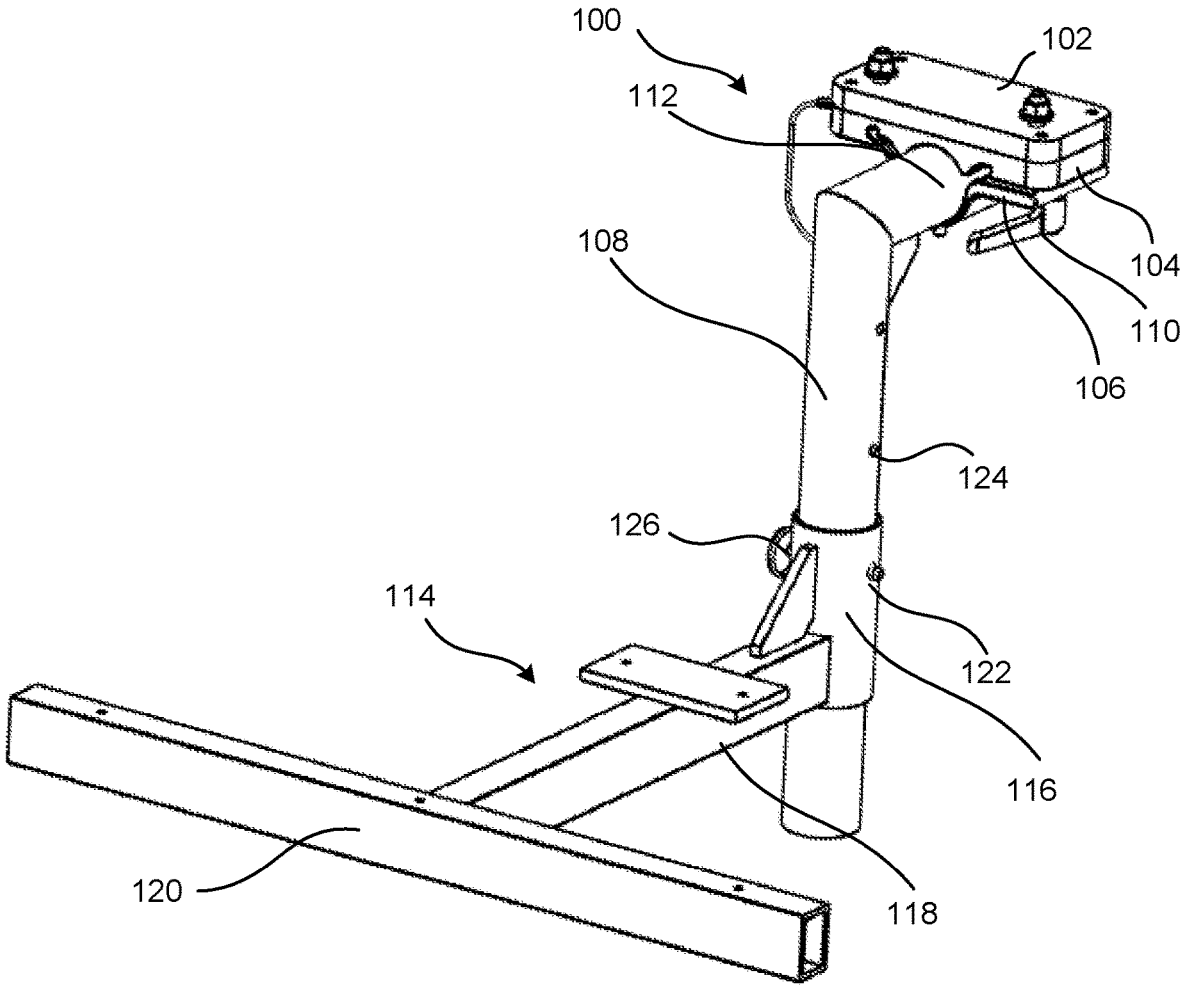
FIG. 1 is a perspective exploded view of a clamping system, assembly arm, and undermount assembly, according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a clamping system for a mounting surface. The current invention is adapted to be mounted to a mounting surface, such as a deck or under the deck of a pontoon boat, but may also be mounted to other structures including any vertical or horizontal surfaces. The clamping system allows for various entertainment accessories, such as tables, grills, and coolers, and to transport various water toys. While some accessories must be removed from the clamping system before the boat docks, the clamping system may remain safely affixed to the boat while the boat is in operation, allowing for easily reattachment of an accessory in the future. The clamping system includes a mounting block, adapted to engage a mounting surface, such as a pontoon boat cross brace, a clamping block engaged with the mounting block, and a clamping member, that together with the clamping block, cooperatively defines a retaining area. This retaining area is adapted to receive and releasably couple an assembly arm. The clamping member is pivotably coupled to the clamping block at a first end. In a closed position, the clamping member includes a closing mechanism on a second end to engage the second end of the clamping member to the clamping block. When the clamping member is in the closed position, the assembly arm is releasably coupled to the clamping system, and the mounting surface to which it is attached. The assembly arm preferably has an L-shape, including a clamping section that is retained by the clamping block and clamping member, and a vertical portion that extends downwardly, and is substantially perpendicular to the clamping section when assembled. In another embodiment, the assembly arm is straight. In another embodiment, a vertical mounting member is retained in the retaining area defined by the clamping block and clamping member. Entertainment unit accessories may be coupled to the assembly arm, and the assembly arm supports the accessories, such as in a position close to the water so they may be accessed by people who are outside of the boat, preferably standing in the water. The clamping section may rotate relative to the clamping block, and the clamping section is selectively retained at a desired angle by closing in the retaining area so the accessory is substantially level. The clamping system allows for rotation of the entertainment unit accessory relative to the mounting surface, allowing the user to level the accessory, such as a table or grill, so that it is level with the water or ground. Once the assembly arm is releasably coupled in the retaining area from friction of the clamp, a pin may be inserted through one of a plurality of holes in the clamping section and clamping member to releasably couple the assembly arm, and prevent it from falling out or unintended rotation relative to the clamping block. The holes of the clamping member are preferably angularly staggered along the clamping member, so that when the pin is used to couple the assembly arm to the clamping member, the assembly arm may be selectively positioned, for example, 0 to 8 degrees from perpendicular in 2 degree increments, relative to the clamping block. This ensures that accessories, such as a grill, table, or cooler, are suitable for use in a substantially level position. This also provides a safety feature that ensures that accessories cannot accidently rotate relative to the clamping block.

The assembly arm includes further holes along the vertical portion that allow for an undermount assembly to be raised or lowered relative to the mounting surface, based on the desired height of the accessory. A pin may be used to releasably couple the assembly arm to the undermount assembly, via selecting holes in the assembly arm and respective holes in the undermount assembly.

When the clamping system is mounted to a mounting surface, such as a pontoon boat, the clamping system is preferably attached to a cross brace of the pontoon deck. In another embodiment, the clamping system may be mountable to docks, decks, ski-tow towers, ski-tow bars or ski-tow pylons. In an embodiment, and since mounting surfaces, such as pontoon boats, have different configurations, depending on the manufacturer or model, it is necessary to provide different types and sizes of adaptive mounting blocks suitable for the particular mounting surface design.

Referring to FIGS. 1-12, a clamping system 100 is illustrated according to embodiments of the present invention. The clamping system 100 may include a mounting block 102 for coupling to a mounting surface, such as, for example, the bottom surface of a cross brace of a pontoon boat. The clamping system includes a clamping block 104 and a clamping member 106 coupled to the clamping block 104, and the clamping block 104 and the clamping member 106 cooperatively define a retaining area 107 to releasably couple an assembly arm 108. The mounting block 102 includes holes for respectively receiving screws, bolts, or other fasteners, and these fasteners are used to secure the mounting block 102 to a mounting surface. The holes of the mounting block 102 are arranged to allow for coupling to various mounting surface designs. The mounting block 102 also includes holes for respectively receiving fasteners for connecting the mounting block 102 to the clamping block 104. Alternatively, the clamping block 104 may be coupled to a mounting surface, without the need for a mounting block 102. The clamping block 104 is illustrated as a rectangle, but it will be appreciated that other shapes may also be used, without departing from the scope and spirit of the present invention. The clamping block 104 includes a substantially flat top portion that engages the mounting block 102 and a bottom portion that includes a curved portion that is adapted to engage a portion of the assembly arm 108, when the assembly arm 108 is inserted. The clamping member 106 is coupled to the clamping block 104 substantially at a first end 109 of the clamping member 106 in a pivotable manner. The clamping member 106 includes a curved portion that substantially conforms to the cylindrical cross section of the assembly arm 108. The clamping member 106 includes a lock lever 110 for selectively securing a second end 111 of the clamping member 106 to the clamping block 104. The assembly arm 108 includes a clamping section 112 of the assembly arm, which is in contact with the clamping block 104 and clamping member 106. The clamping section 112 defines a first end of the assembly arm 108. In an embodiment, the clamping section 112 has a cross section that is substantially cylindrical. In an embodiment, the clamping section 112 includes holes 113 along its length, which may be angularly offset relative to each other.

The assembly arm 108 is adapted to releasably couple to an undermount assembly 114. The undermount assembly is adapted to hold various entertainment unit accessories. The undermount assembly includes a cylindrical portion 116 that is adapted to receive the assembly arm 108. The undermount assembly also includes a first support bar 118 and a second support bar 120. Additional support bars may be provided to provide additional support for desired accessories. In an embodiment, and as shown in FIG. 1, the first support bar 118 has first and second ends, wherein the first end is attached to the cylindrical portion 116, and the second end is attached to the second support bar 120. It will be understood that the second support bar 120 could also be coupled at a location between the first and second ends of the first support bar 118. The cylindrical portion 116 includes holes 122 and the assembly arm includes holes 124 and a pin 126 may be inserted through the cylindrical portion holes 122 and the respectively aligned assembly arm holes 124 to couple the undermount assembly 114 in relation to the assembly arm 108. The elevation of the undermount assembly 114 may be changed relative to the clamping section 112 of the assembly arm 108 by securing the cylindrical portion 116 to the assembly arm 108 via the pin 126 and one of the assembly arm holes 124, using assembly arm holes 124 that are proximal to the clamping section 112 of the assembly arm 108. The various accessories held by the undermount assembly 114 may include, for example, serving trays, tables, grills, coolers, kayaks, paddle boards, floating mats, camera mounts and beverage holders. It will be appreciated that the foregoing list of accessories are merely exemplary, and the present invention is not limited to any specific accessory attachment.

Figure 2:
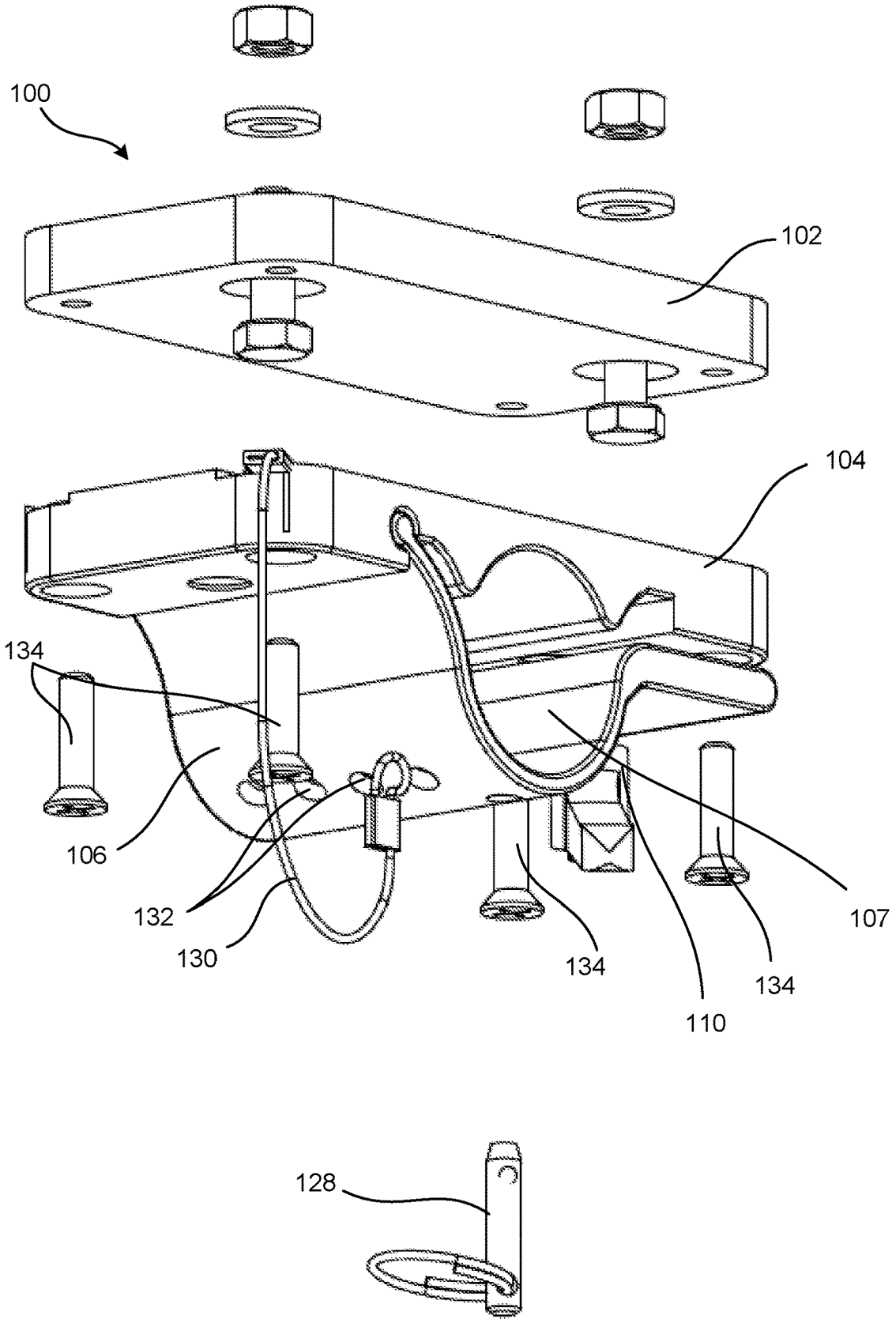
FIG. 2 is a disassembled, left side perspective view of a clamping system, according to an embodiment of the present invention.

Referring to FIG. 2, the mounting block 102, clamping block 104, and clamping member 106 are shown in more detail. The clamping member 106 may be coupled to the clamping block 104 on one end by a tongue and groove mechanism, as illustrated. Other attachment mechanisms may also be used, such as hinges. In an embodiment, a rotation pin 128 is secured to the clamping block by a pin retaining cable 130 to prevent loss of the pin 128. The clamping member 106 includes holes 132 adapted to receive the quick pin 128 and couple the clamping member 106 to the assembly arm 108 via corresponding holes 113 in the clamping section 112 of the assembly arm. The holes 113 of the clamping section 112 may be arranged linearly, as shown, or alternatively arranged. Preferably the clamping member 106 is configured to have a substantially circular shape, preferably where the clamping member 106 defines half of a cylinder. Four fasteners 134 are shown for coupling the clamping block 104 to the mounting block 102. It will be understood that the fasteners may be threaded screws, bolts, or other suitable fasteners, and any number can be used.

Figure 3:
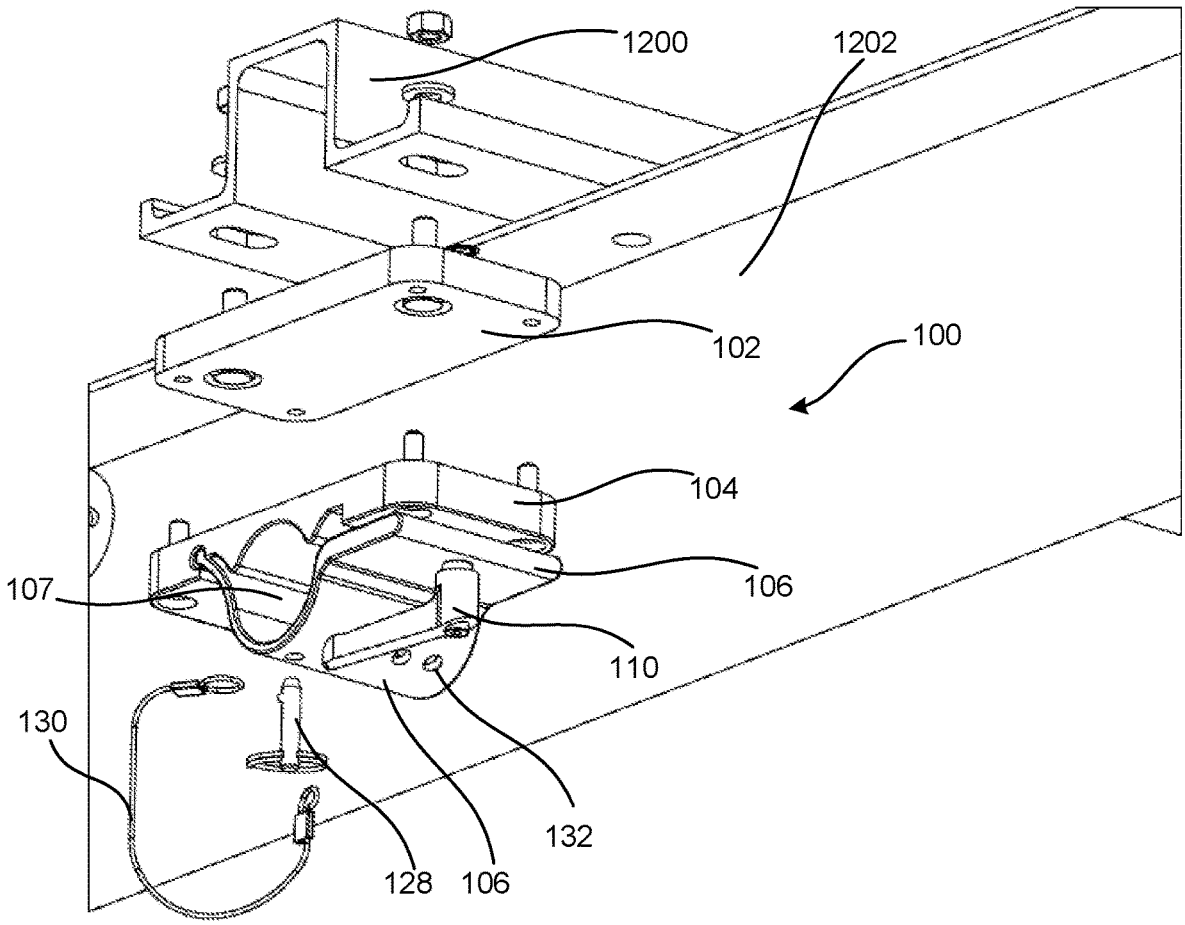
FIG. 3 is a disassembled, right side perspective view of clamping system, according to an embodiment of the present invention, with an exemplar mounting surface.

Referring to FIG. 3, an embodiment of the clamping system 100 is shown in an exploded view, for coupling to a mounting surface, such as an exemplar pontoon boat cross brace 1200. Also illustrated is a closeout extrusion 1202 of a pontoon boat. The pontoon boat, including the pontoon boat cross brace 1200 and the closeout extrusion 1202, are not part of the present invention, but are rather common and typical pontoon boats.

Figure 4:
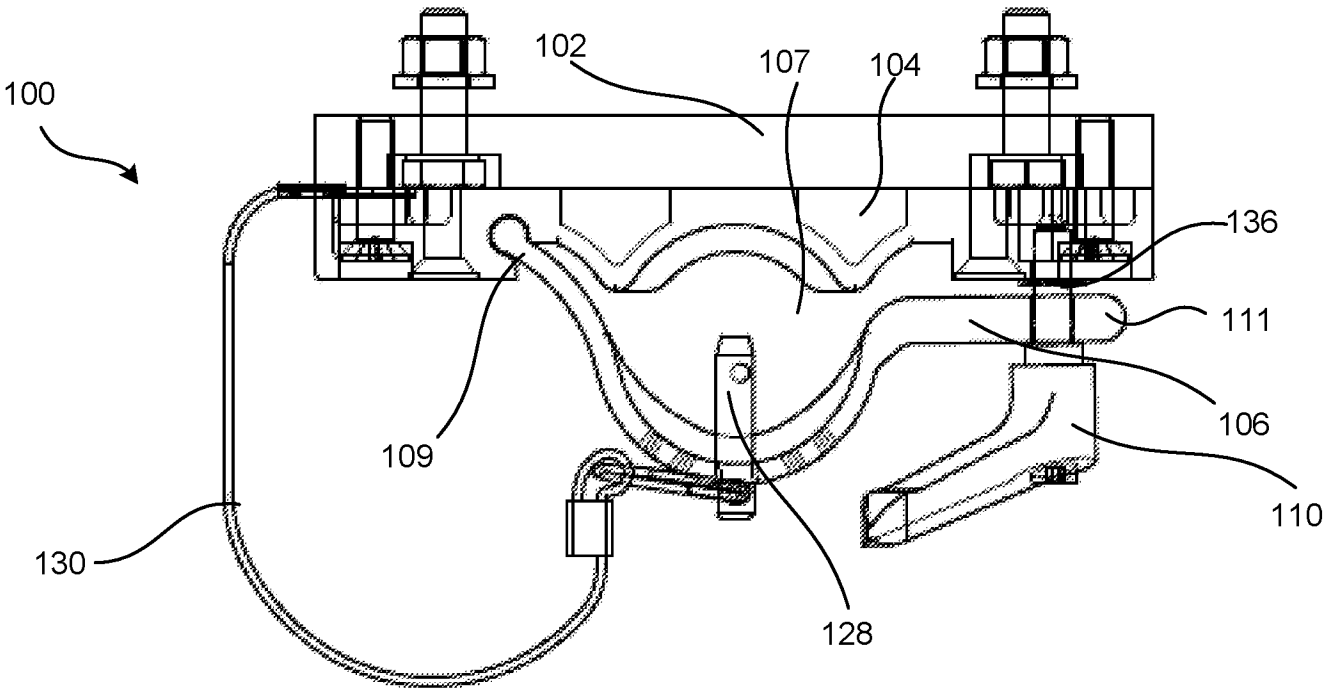
FIG. 4 is a phantom side view of a clamping mount and mounting block, according to an embodiment of the present invention.
Figure 5:
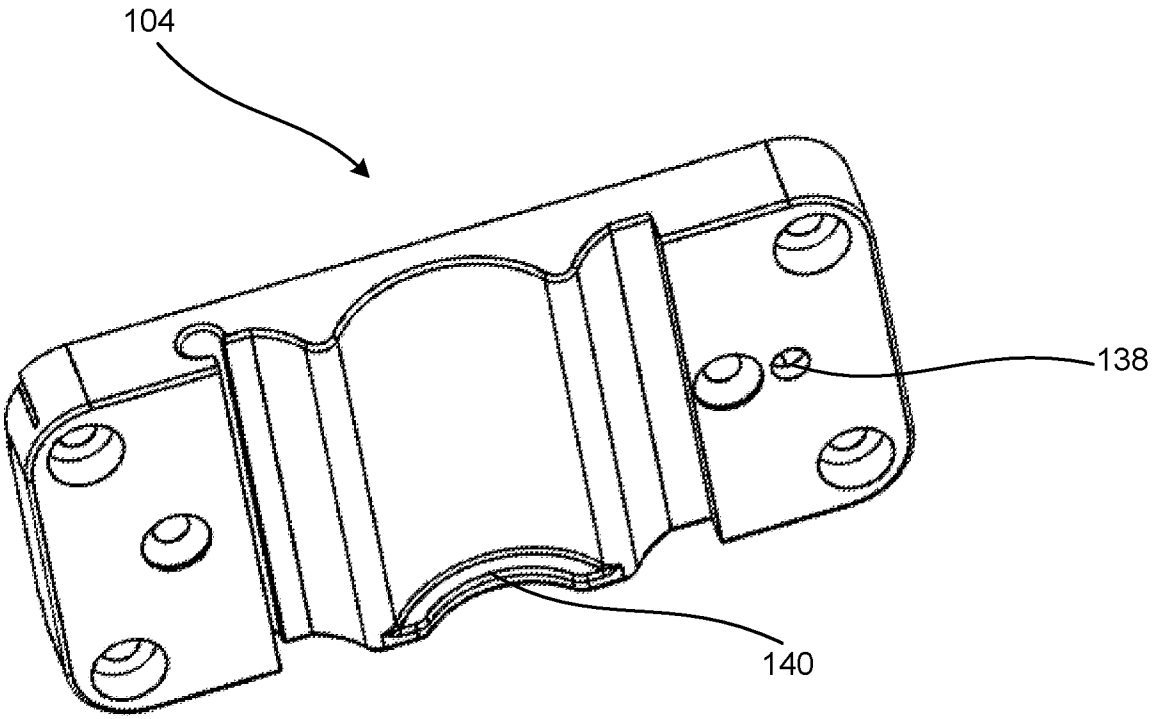
FIG. 5 is a perspective side view of a mounting block, according to an embodiment of the present invention.

Referring to FIGS. 4 and 5, an embodiment of the clamping system 100 is shown in phantom view. The lock lever 110 is retained in position by retainer washer 136 to selectively retain the lock lever 110 in a position with the clamping member 106. The lock lever 110 engages with an opening 138 in the clamping block 104 to secure the clamping member 106 to the clamping block 104 at a second location. The lock lever 110 may be threaded, and the opening 138 in the clamping block may be threaded to threadably engage the threaded portion of the body. The opening 138 may be defined by an embedded fastener, such as a nut embedded in the clamping block 104. The lock lever 110 may also include a retaining protrusion at the end of the body that may be positioned in a groove in the opening 138 of the clamp block 104 when the clamping member is closed. The lock lever 110 may include a spring adapted to allow the user to push the lock lever 110 towards the clamping member 106, allowing the user to selectively close the clamping member more easily.

FIG. 5 illustrates an embodiment of the clamping block 104. The opening 138 receives the lock lever 110 when the clamping member 106 is disposed in a closed position, that is, when the clamping block 104 and the clamping member 106 are engaged with the clamping section 112. The clamping block 104 may include a ridge 140 for engaging the clamping section 112 of the assembly arm 108 to prevent the assembly arm 108 from moving past the retaining area 107.

Figure 6:
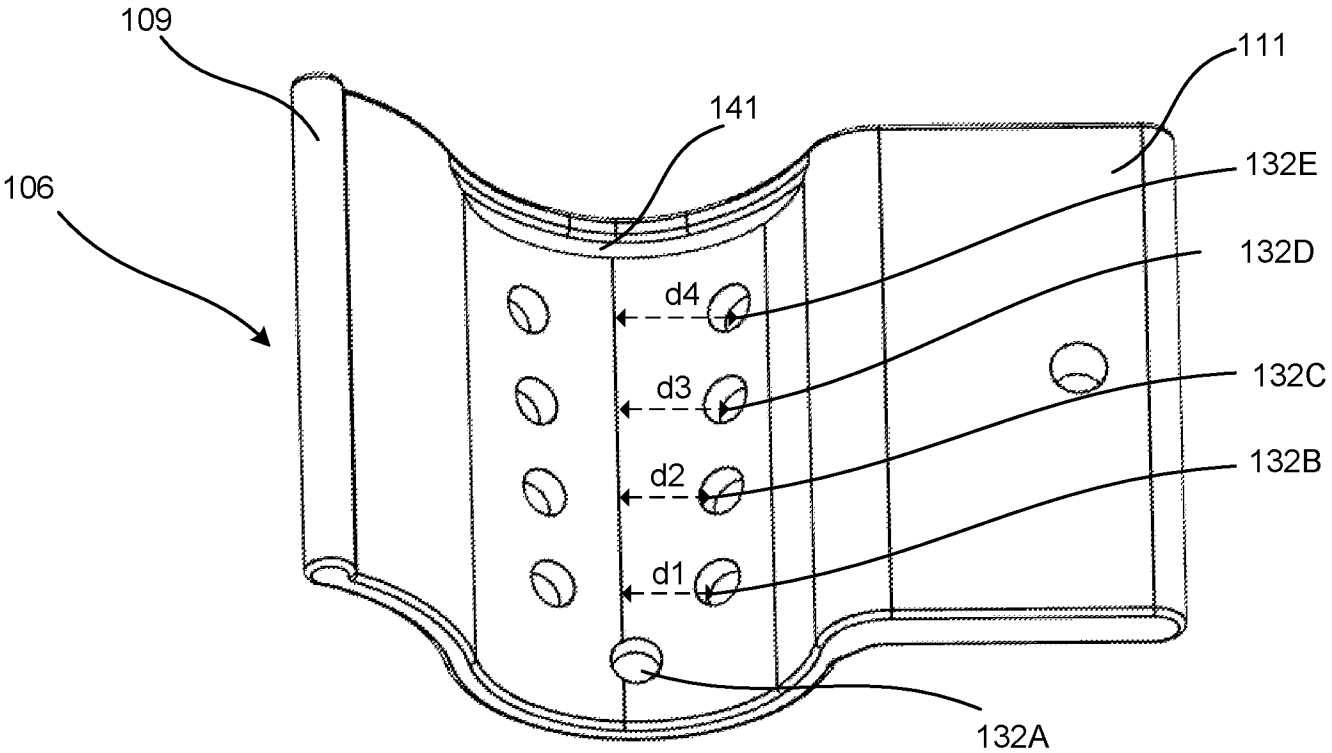
FIG. 6 is a perspective side view of a clamping member, according to an embodiment of the present invention.

FIG. 6 illustrates a clamping member 106, which includes holes 132 for accepting a quick pin 128. The clamping member 106 may include a ridge 141 for engaging the clamping section 112 of the assembly arm 108 to prevent the assembly arm 108 from moving in the retaining area 107 and provide selective positioning assistance when the assembly arm 108 is being positioned in the retaining area 107 by a user. The clamping member may also include holes 132, such as 132A, 132B, 132C, 132D, and 132E. These holes may be positioned to secure the assembly arm 108 in a selected elevation position relative to the clamping block 104, using rotational pin 128. For example, hole 132A may be positioned at the bottom of the clamping member 106, relative to the clamping block 104, when the clamping member 106 is in a closed position. The rotational pin 128 received in hole 132A and aligned hole 113 of the clamping section 112 would secure the assembly arm 108 in a selected elevational position relative to the clamping block 104. The holes 132B-132E may also be rotationally positioned a distance, such as d1, d2, d3, or d4, from a midline along the bottom of the of the clamping member 106. The holes 132 may be selectively positioned so that the clamping system 100 is adapted to releasably couple the assembly arm 108, such as, for example, in a position that is approximately 0 to 8 degrees away from perpendicular, such as 0, 2, 4, 6, or 8 degrees away from perpendicular. For example, hole 132B may be positioned a rotational distance of d1 away from the midline to secure the assembly arm 108 in a rotational position that is about 2 degrees away from perpendicular. Hole 132C may be positioned a rotational distance of d2 away from the midline to secure the assembly arm 108 in a rotational position that is about 4 degrees away from perpendicular, and the hole is proximal to the ridge 141 relative to hole 132B. Hole 132D may be positioned a rotational distance of d3 away from the midline to secure the assembly arm 108 in a rotational position that is about 6 degrees away from perpendicular, and the hole is proximal to the ridge 141 relative to hole 132B and 132C. Hole 132E may be positioned a rotational distance of d4 away from the midline to secure the assembly arm 108 in a rotational position that is about 8 degrees away from perpendicular, and the hole is proximal to the ridge 141 relative to holes 132B, 132C and 132D. Holes 132A-132E may be included on both sides of the midline of the clamping member 106 so that the assembly arm can be rotated from perpendicular in either direction. For example, the clamping system 100 may be mounted on the port side or the starboard side of a pontoon boat. The holes 113 in the clamping section 112 are preferably arranged linearly along the length of the clamping section 112. The clamping section 112 may include 12 holes. It will be understood that the holes allow a user to adjust the levelness of the coupled entertainment unit accessory. It will be evident to those skilled in the art that more of fewer holes may be provided on the clamping member 106 and the clamping section 112 without departing from the spirit and scope of the present disclosure.

Figure 7:
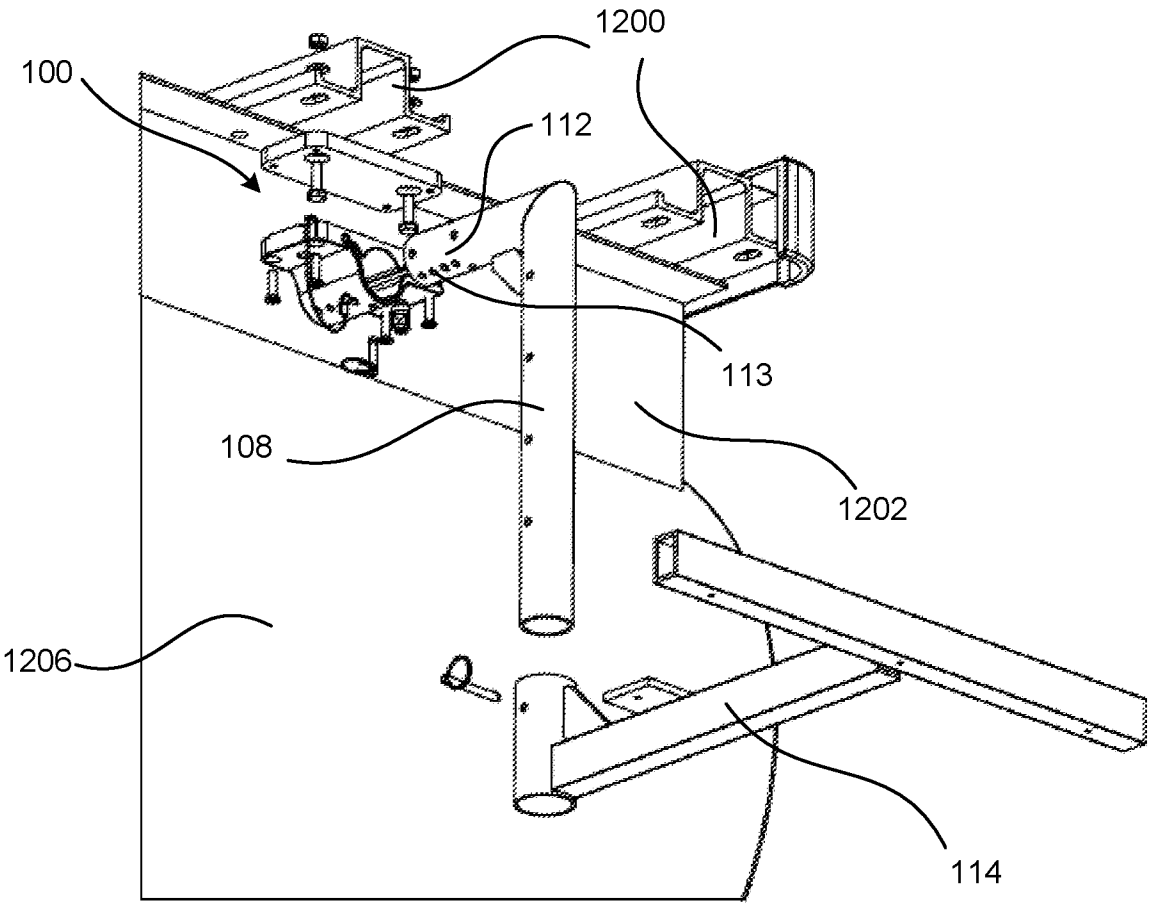
FIG. 7 is a disassembled, left side perspective view of the clamping system, assembly arm, and undermount assembly, according to an embodiment of the present invention, with an exemplar mounting surface.
Figure 8:
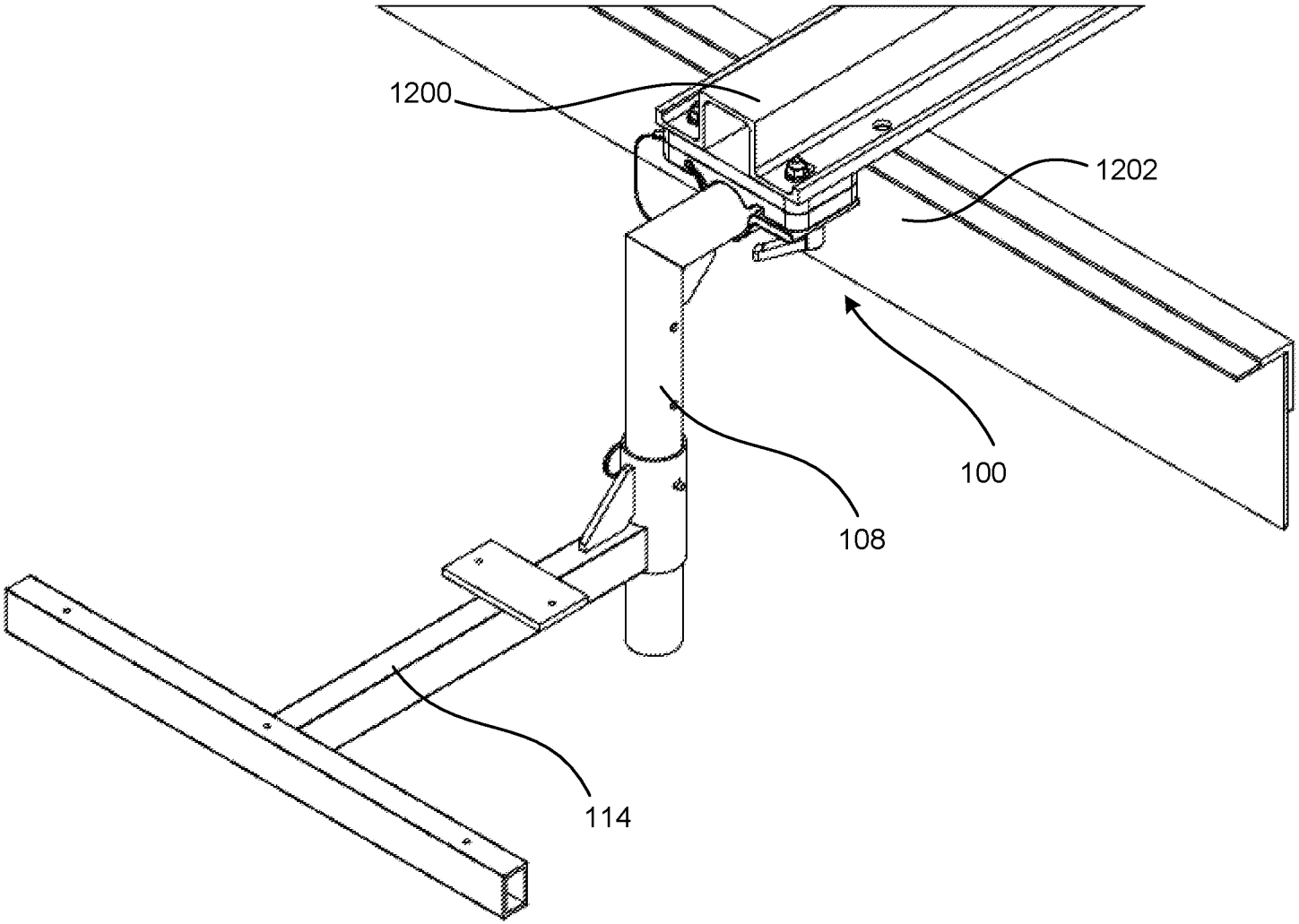
FIG. 8 is an assembled right side perspective view of the clamping system, assembly arm, and undermount assembly, according to an embodiment of the present invention, with an exemplar mounting surface.
Figure 9:
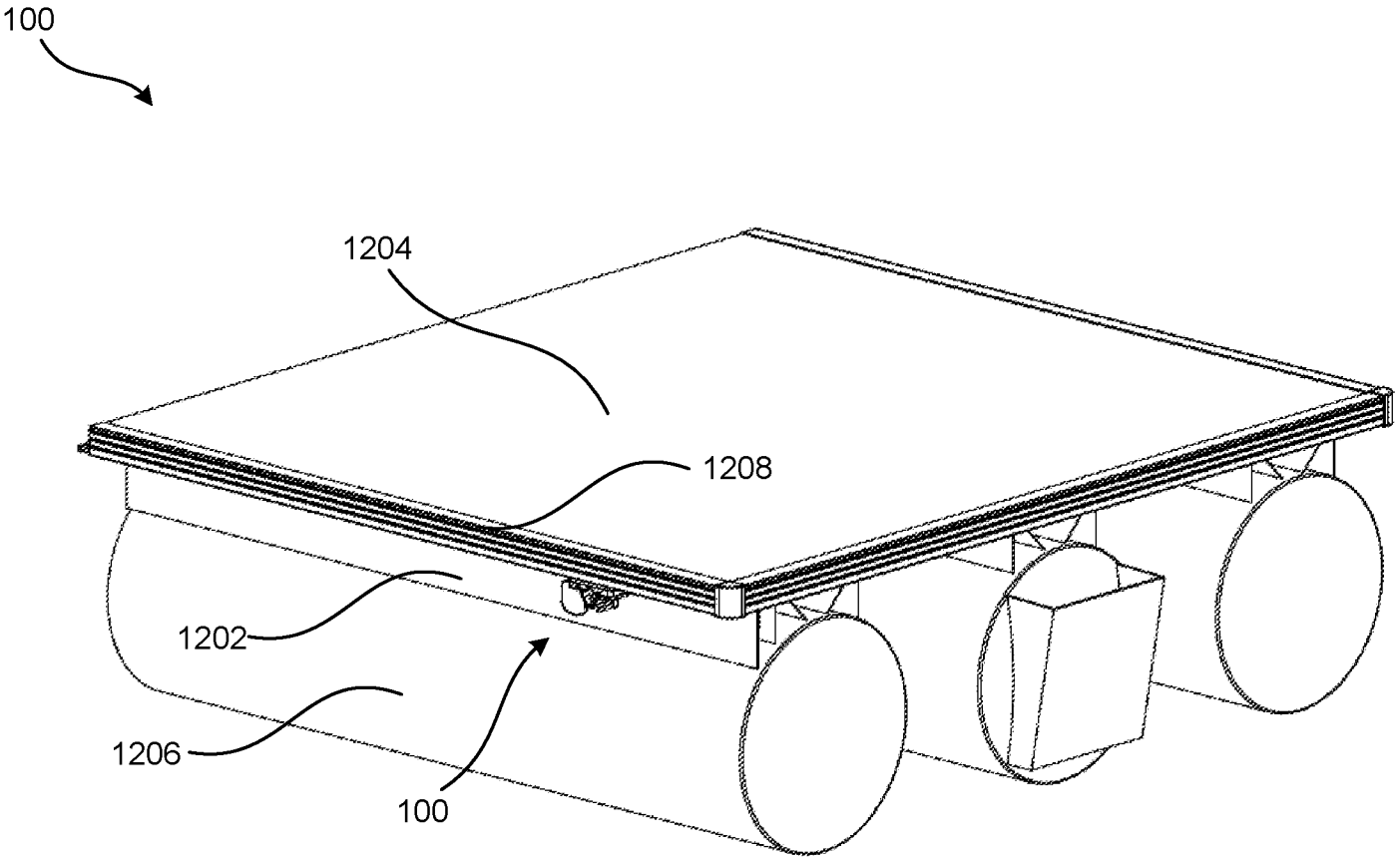
FIG. 9 is a right side perspective view of the clamping system, according to an embodiment of the present invention, with an exemplar mounting surface.

FIG. 7-9 illustrate an embodiment of the clamping system 100 attached to a mounting surface, such as a pontoon boat having a pontoon deck 1204, closeout extrusion 1202, a pontoon 1206, and trim 1208. It will be understood that the clamping system 100 may be coupled to any of the cross braces 1200, located under the deck 1204, to provide the clamping system 100 and an accessory at the desired location on the boat.

Figure 10:
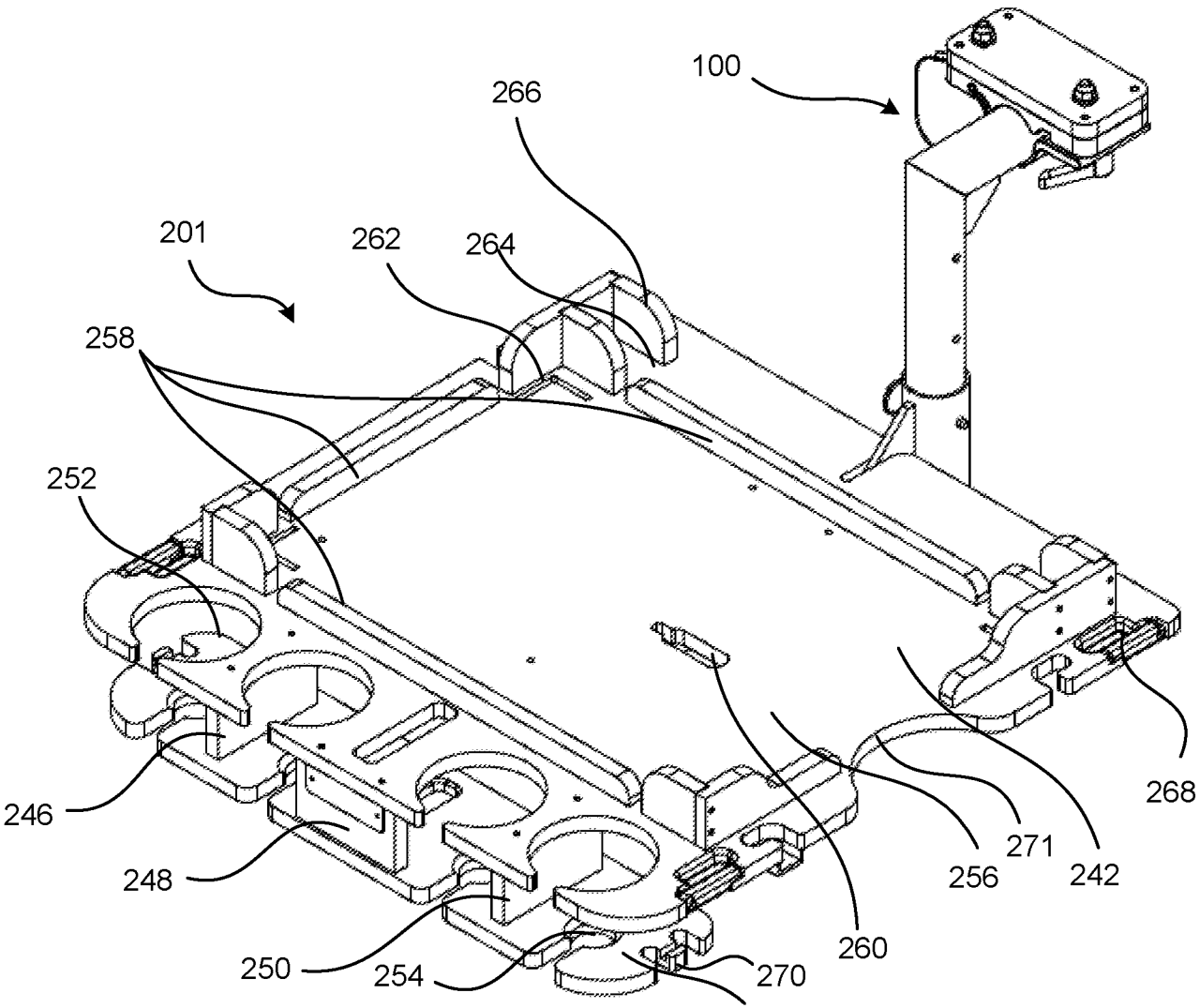
FIG. 10 is a perspective view of a clamping system and exemplar entertainment unit, according to an embodiment of the present invention.
Figure 11:
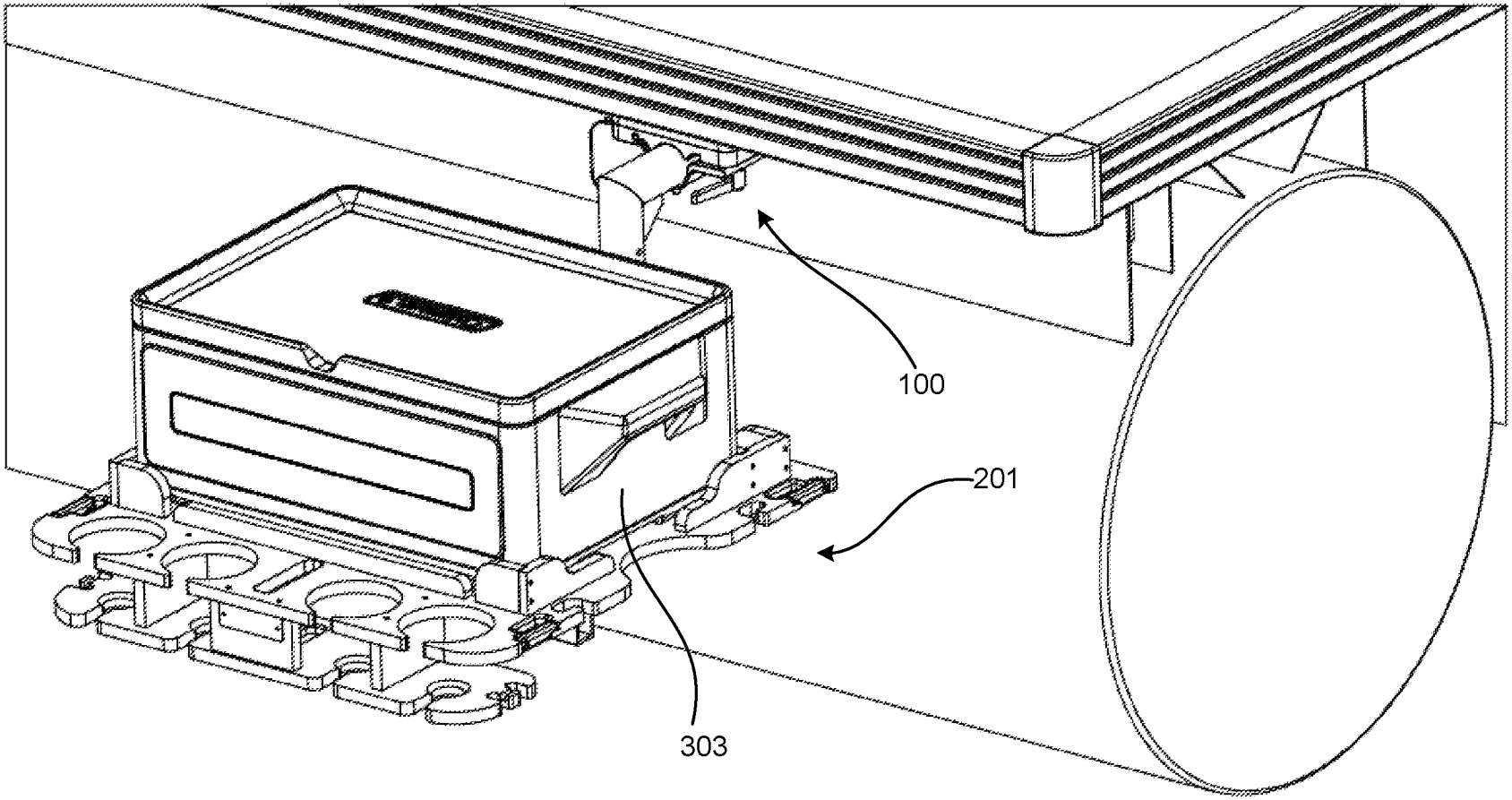
FIG. 11 is a perspective view of a clamping system and exemplar entertainment unit, according to an embodiment of the present invention, with an exemplar mounting surface.

FIG. 10 illustrates an exemplar entertainment unit accessory 201. The exemplar entertainment unit accessory 201 may include a first portion 242 and a second portion 244. The first portion is adapted to be coupled to the assembly arm 114. The second portion 244 is coupled to the first portion 242 by first, second, and third supports 246, 248, 250. The first portion 242 may include recesses or apertures 252 for holding, for example, cups or cans. The second portion 244 is adapted to provide support for a cup or can. The second portion 244 may also include apertures 254 to respectively retain stems of wine glasses or other stemware. The first portion 242 may include a storage area 256, defined by retaining portions 258. The storage area 256 may also include a grill retaining slot 260 and grooves 262 adapted to retain a grill leg 407 in the desired position. The grill may include four grill legs 407 retained by four grooves 262. The first portion 242 may also include a cooler lid storage area 264, defined by lid retainers 266. The entertainment unit 201 may also include trash bag storage clips 268 on the first portion 242, and grill tool holder notches 270 on the second portion 244 as illustrated.

Figure 12:
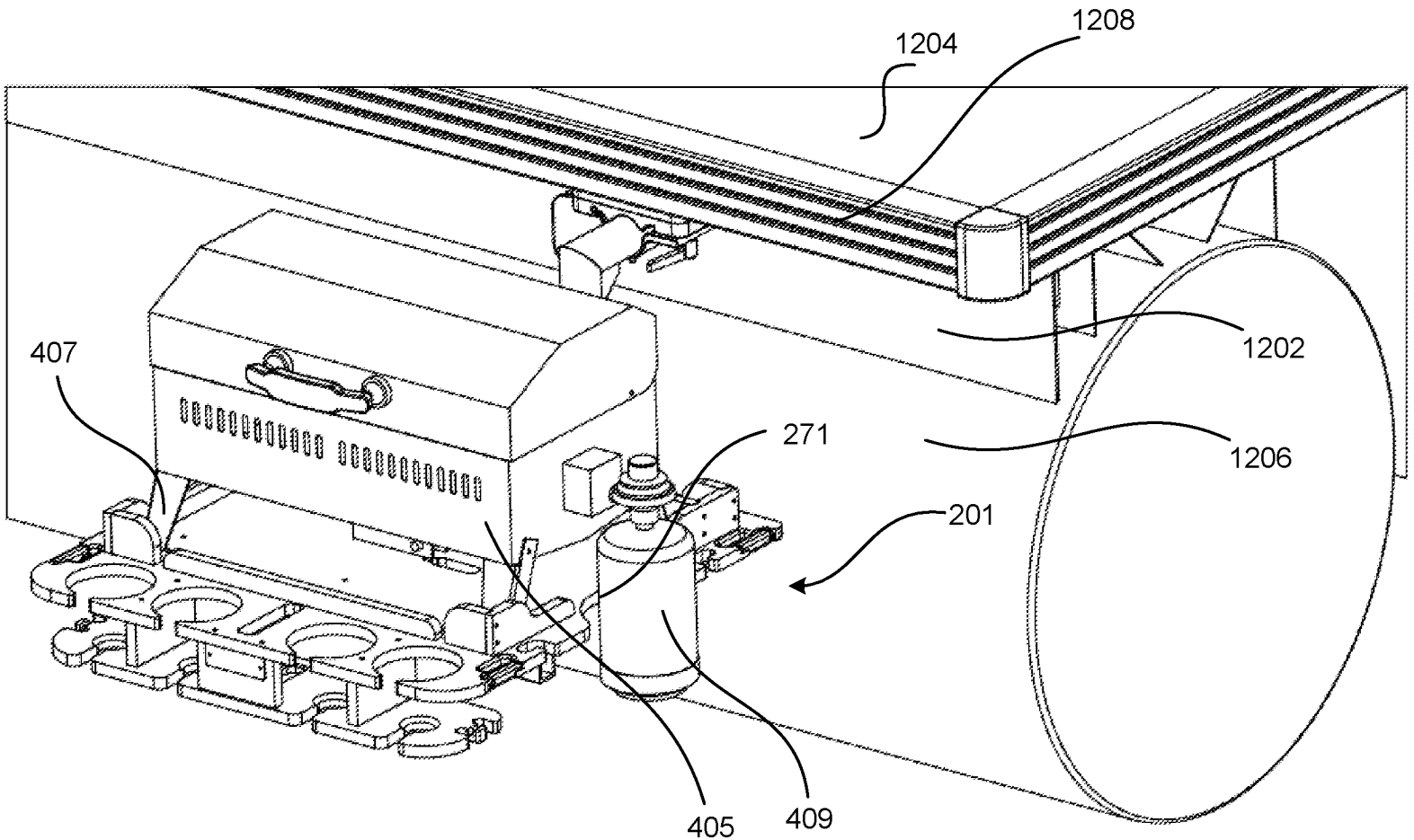
FIG. 12 is a perspective view of a clamping system and exemplar entertainment unit, according to an embodiment of the present invention, with an exemplar mounting surface.

FIG. 12 illustrates an exemplar grill 405 coupled to the entertainment unit 201. The grill 405 may include grill legs 407 and a gas tank 409. A gas tank relief cut-out 271 may provide a space for the gas tank 409 of the grill 405.

Figure 13B:
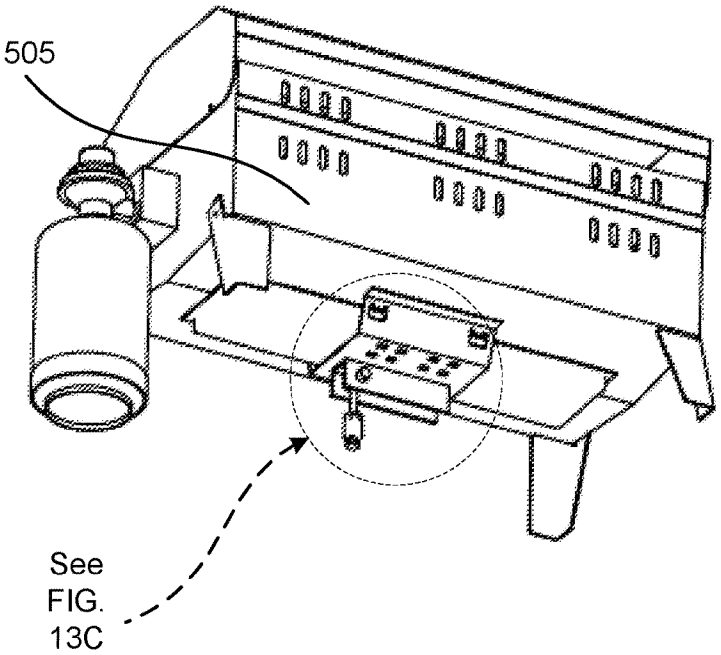
FIG. 13B a bottom perspective view of the exemplar entertainment unit, such as a grill, of FIG. 13A.
Figure 13A:
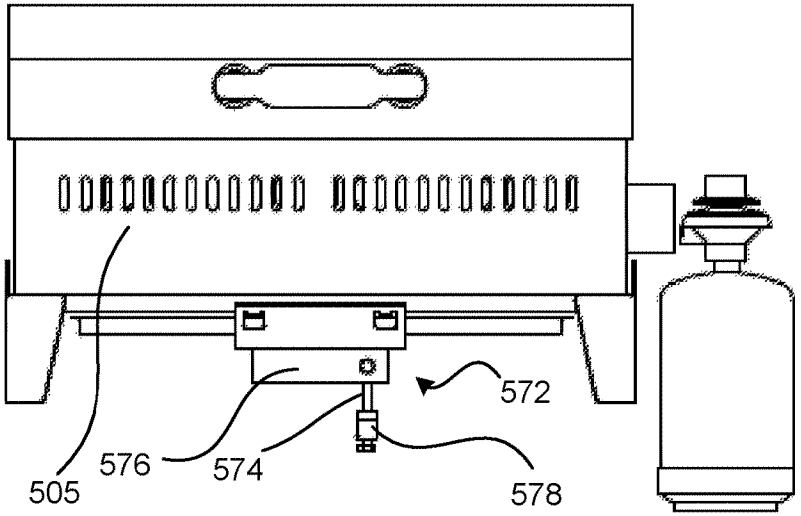
FIG. 13A is a front view of an exemplar entertainment unit, such as a grill, that can be used with embodiments of the present invention.
Figure 13C:
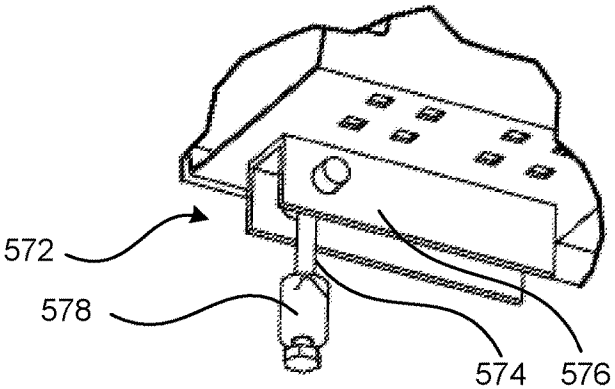
FIG. 13C is an enlarged, detailed perspective view of a security assembly coupled to the exemplar entertainment unit, such as a grill, of FIG. 13A.

FIG. 13A-C illustrate an exemplar grill 505 having a security assembly 572 attached to the bottom of the grill 505. The security assembly 572 may include a bolt 574 pivotably coupled to a mounting channel 576. The bolt 574 may include a knob 578 threadably connected to the bolt 544. The security assembly 572 may be coupled to the bottom of the grill 505 by screws, bolts, rivets, or other suitable attachment mechanisms.

Figure 14B:
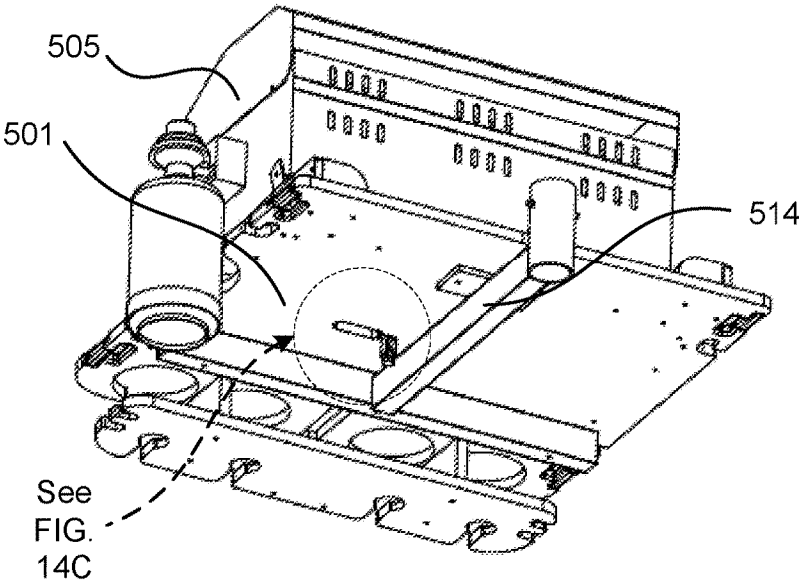
FIG. 14B a bottom perspective view of the exemplar entertainment unit that can be used with embodiments of the present invention, of FIG. 14A.
Figure 14C:
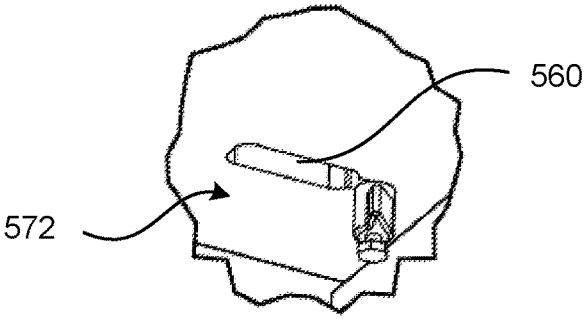
FIG. 14C is a an enlarged detailed perspective view of the exemplar entertainment unit that can be used with embodiments of the present invention, of FIG. 14A.
Figure 14A:
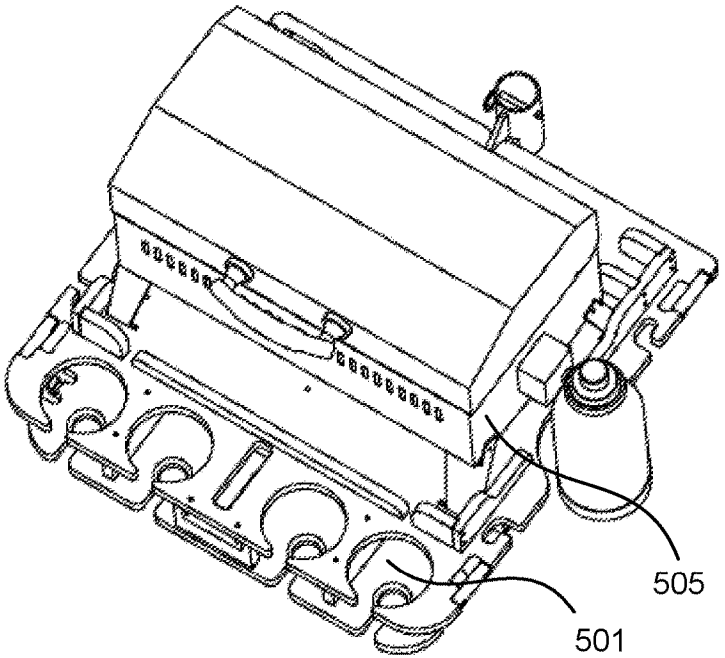
FIG. 14A is a front view of another exemplar entertainment unit that can be used with embodiments of the present invention.
Figure 15A:
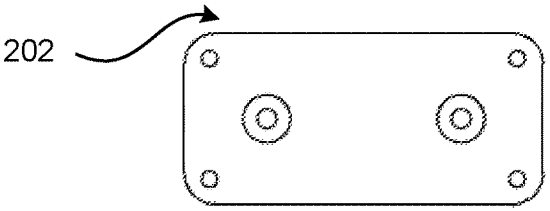
FIGS. 15A, 15B, 15C, 15D, 15E, 15F, 15G, and 15H are bottom views of exemplar mounting blocks adapted to couple to various mounting surfaces, according to various embodiments of the present invention.
Figure 15B:
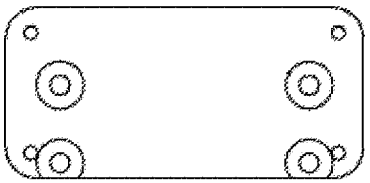
Figure 15C:
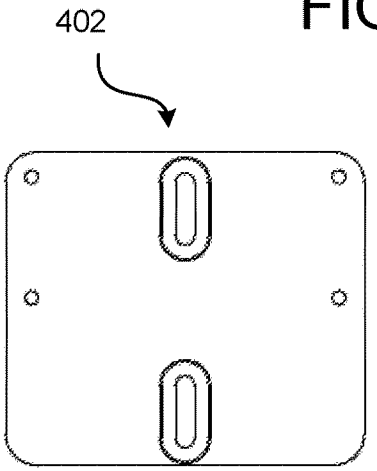
Figure 15D:
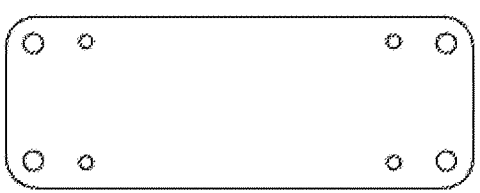
Figure 15E:
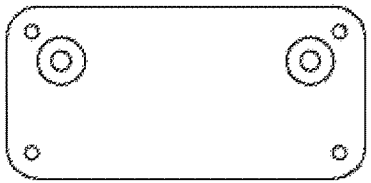
Figure 15G:
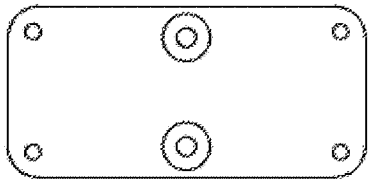
Figure 15H:
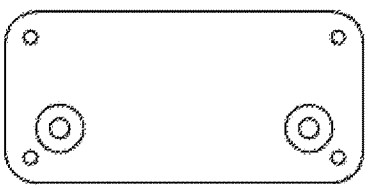
Figure 15F:
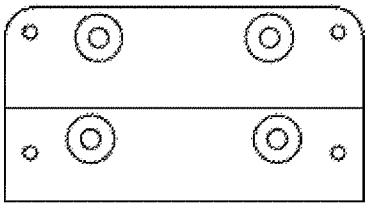

FIG. 14A-C illustrate an exemplar grill 505 coupled to the entertainment unit 501 and the undermount assembly 514 including the security assembly 572 engaged with the grill retaining slot 560.

FIG. 15A-H illustrate various exemplar mounting blocks 202, 302, 402, 502, 602, 702, 802, and 902, adapted to be coupled to various mounting surfaces, such as cross braces designs used by various manufacturers and models of pontoon boats. These mounting blocks are some examples of possible mounting blocks, and additional mounting blocks for various mounting surfaces and/or cross brace configurations will be evident to those skilled in the art and may be made without departing from the spirit and scope of the present disclosure.

Figure 16C:
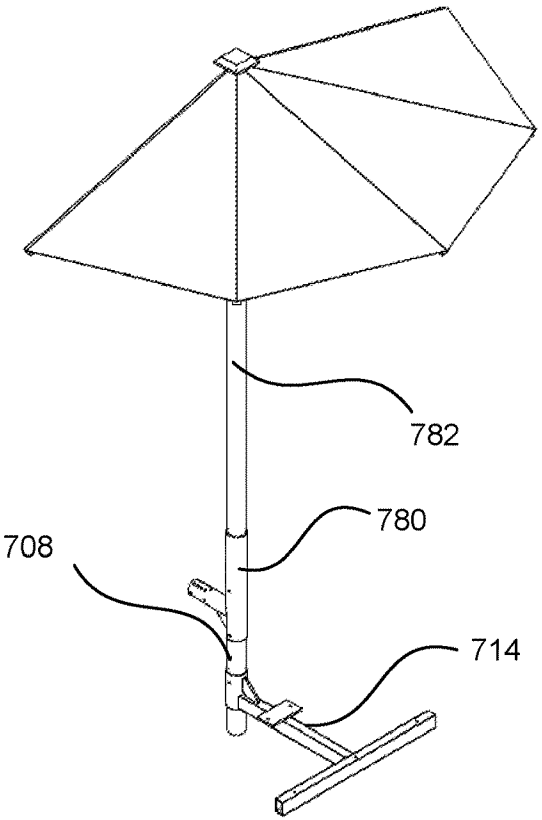
FIG. 16C is a perspective view of the exemplar entertainment unit, such as an umbrella, umbrella holder, an assembly arm, and undermount assembly, of FIG. 16A.
Figure 16B:
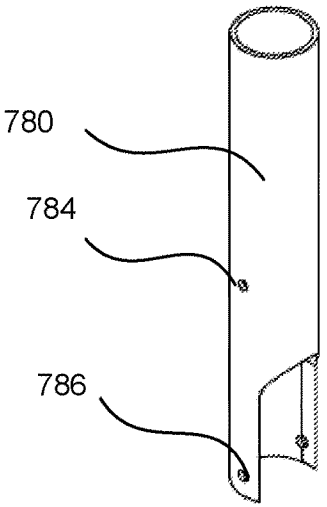
FIG. 16B is a perspective view of an exemplar umbrella holder of FIG. 16A.
Figure 16A:
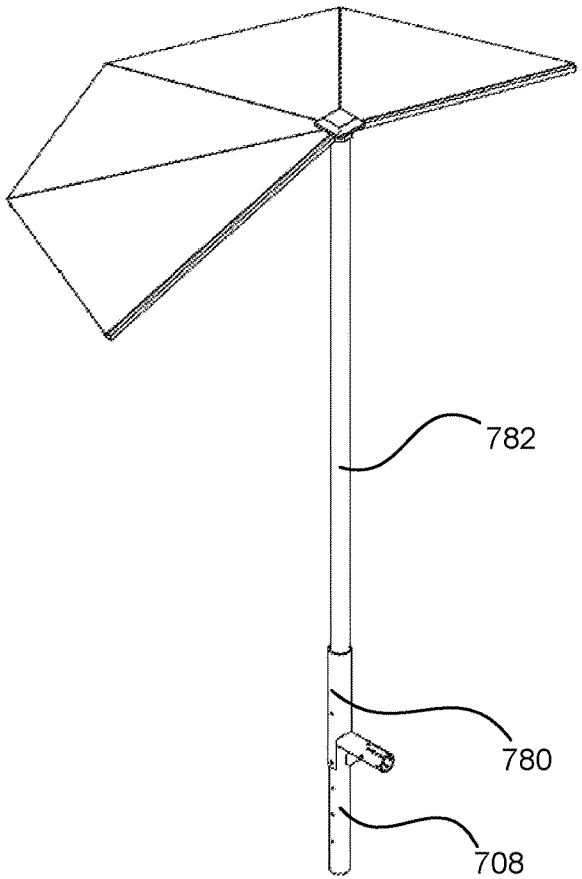
FIG. 16A is a perspective view of another exemplar entertainment unit, such as an umbrella, umbrella holder, and an assembly arm, according to an embodiment of the present invention.

FIG. 16 illustrates another embodiment of the present invention, where an assembly arm 708 coupled to an exemplar umbrella holder 780 for holding, for example, an umbrella 782. The umbrella holder 780 includes holes 784 which may receive a pin, where the pin would provide support for the umbrella 782. The umbrella holder 780 may also include holes 786 for coupling the umbrella holder 780 to the assembly arm 708.

Figure 17:
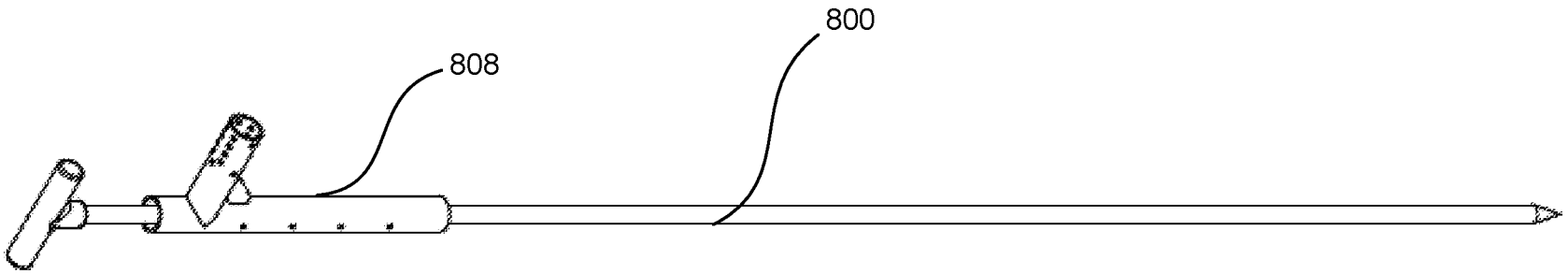
FIG. 17 is a perspective view of an anchor pole according, to an embodiment of the present invention.
Figure 18B:
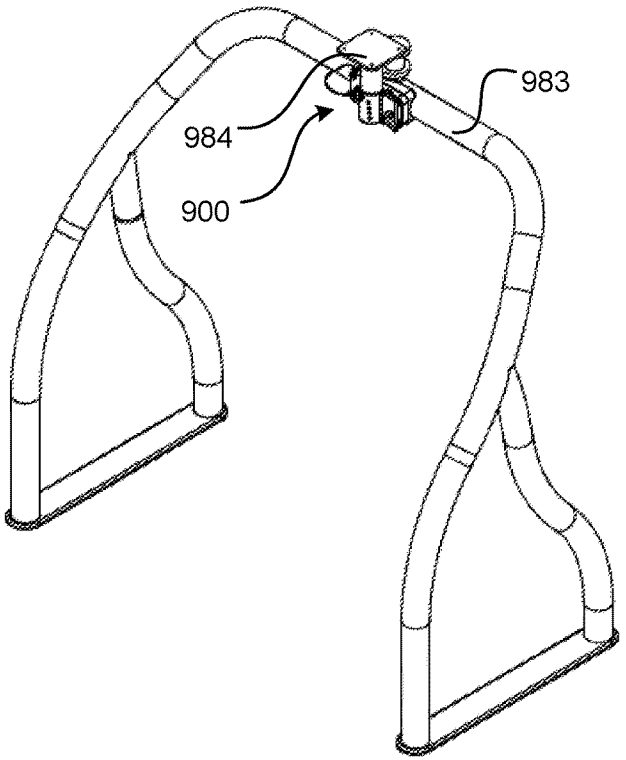
FIG. 18B is a perspective view of the exemplar clamping assembly of FIG. 18A.
Figure 18A:
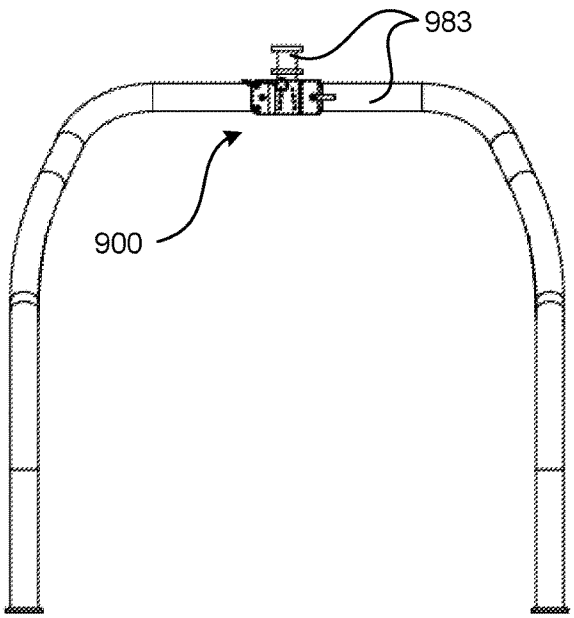
FIG. 18A is a front view of another exemplar clamping assembly coupled to another exemplar mounting surface, such as ski-tow bar, according to an embodiment of the present invention.
Figure 18C:
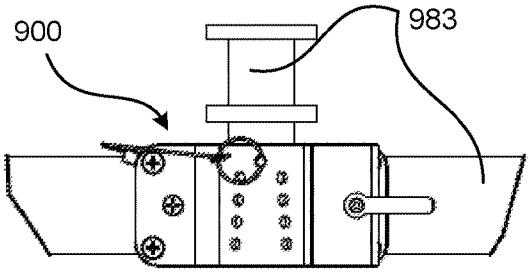
FIG. 18C is an enlarged, detailed front view of the exemplar clamping assembly of FIG. 18A.
Figure 19B:
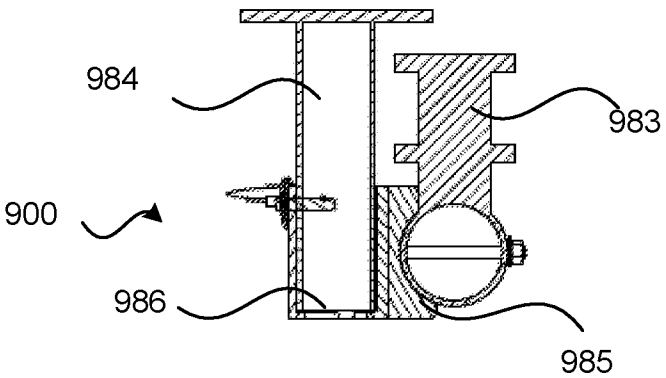
FIG. 19B is a sectioned view of the clamping system of FIG. 19A, taken along line L-L of FIG. 19A.
Figure 19A:
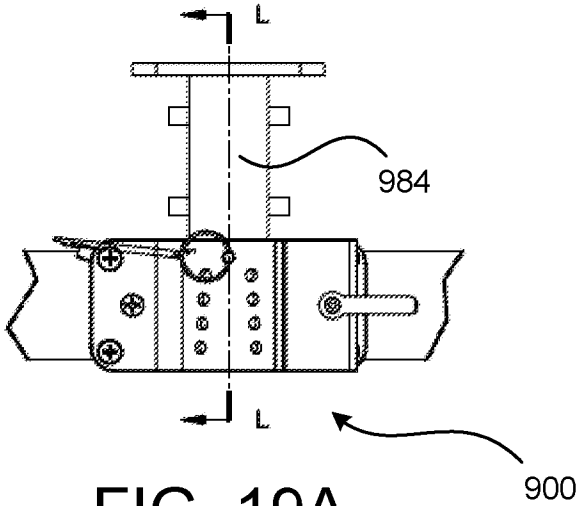
FIG. 19A is an enlarged detail front view of the exemplar clamping system of FIG. 18A, according to an embodiment of the present invention.
Figure 20B:
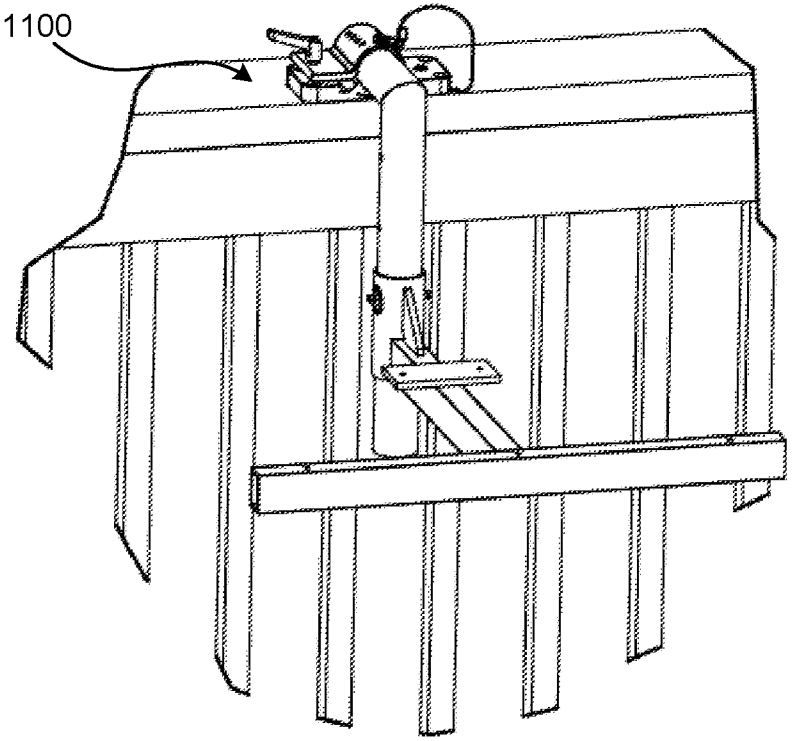
FIGS. 20A, 20B, 21A, 21B, 22A, 22B, 23A, and 23B illustrate an exemplar clamping system mounted in various exemplar mounting surfaces, such as a dock, deck or pole, according to an embodiment of the present invention.
Figure 20A:
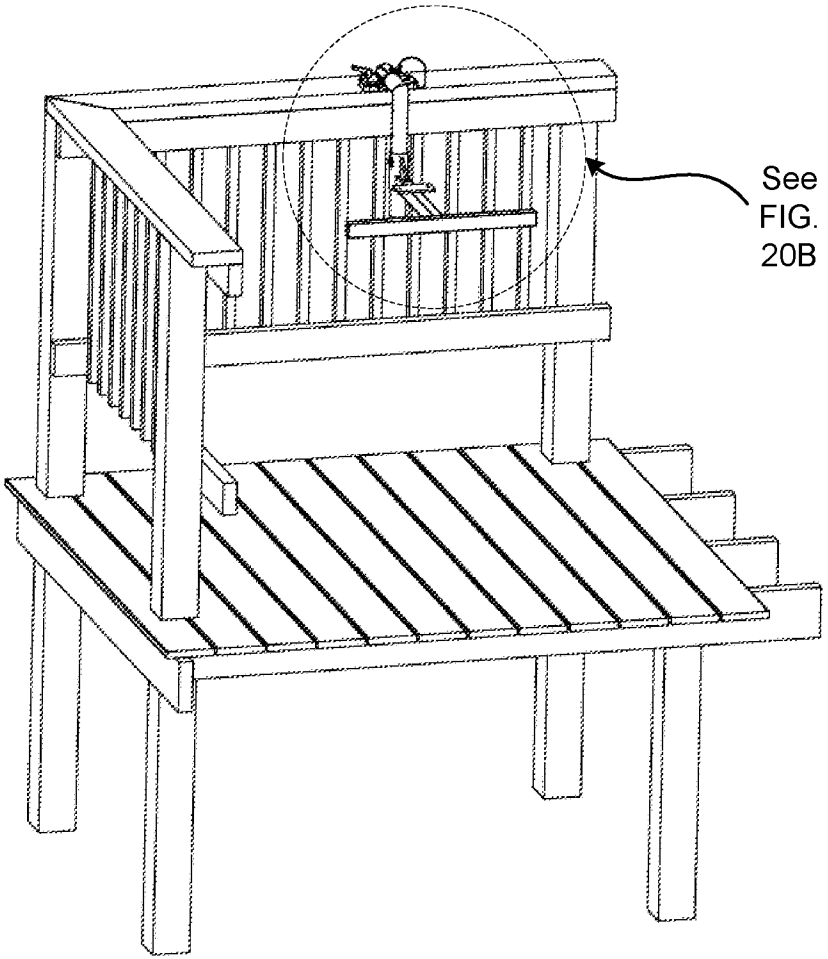
Figure 21B:
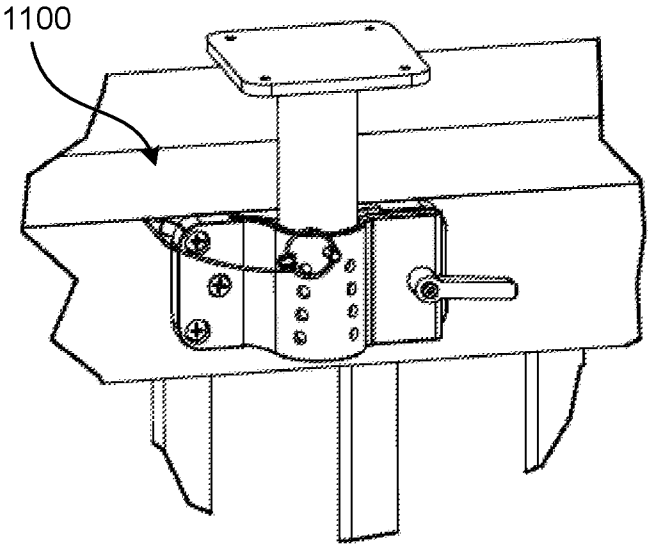
Figure 21A:
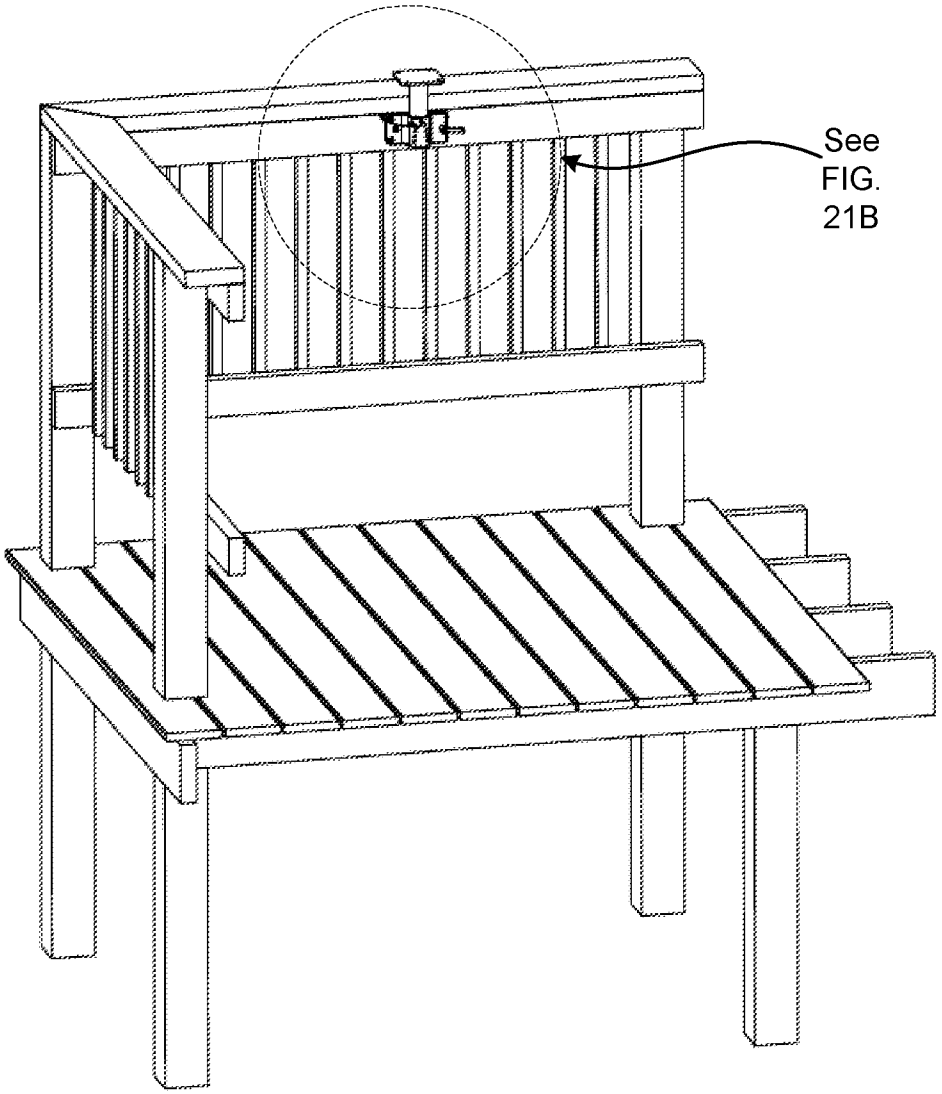
Figure 22B:
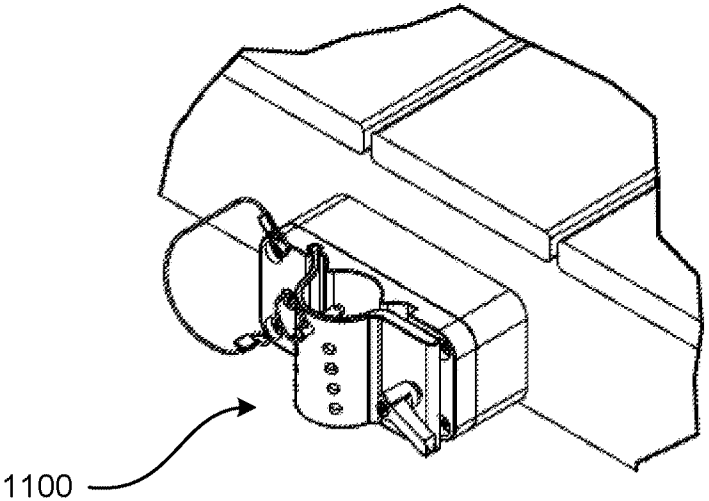
Figure 22A:
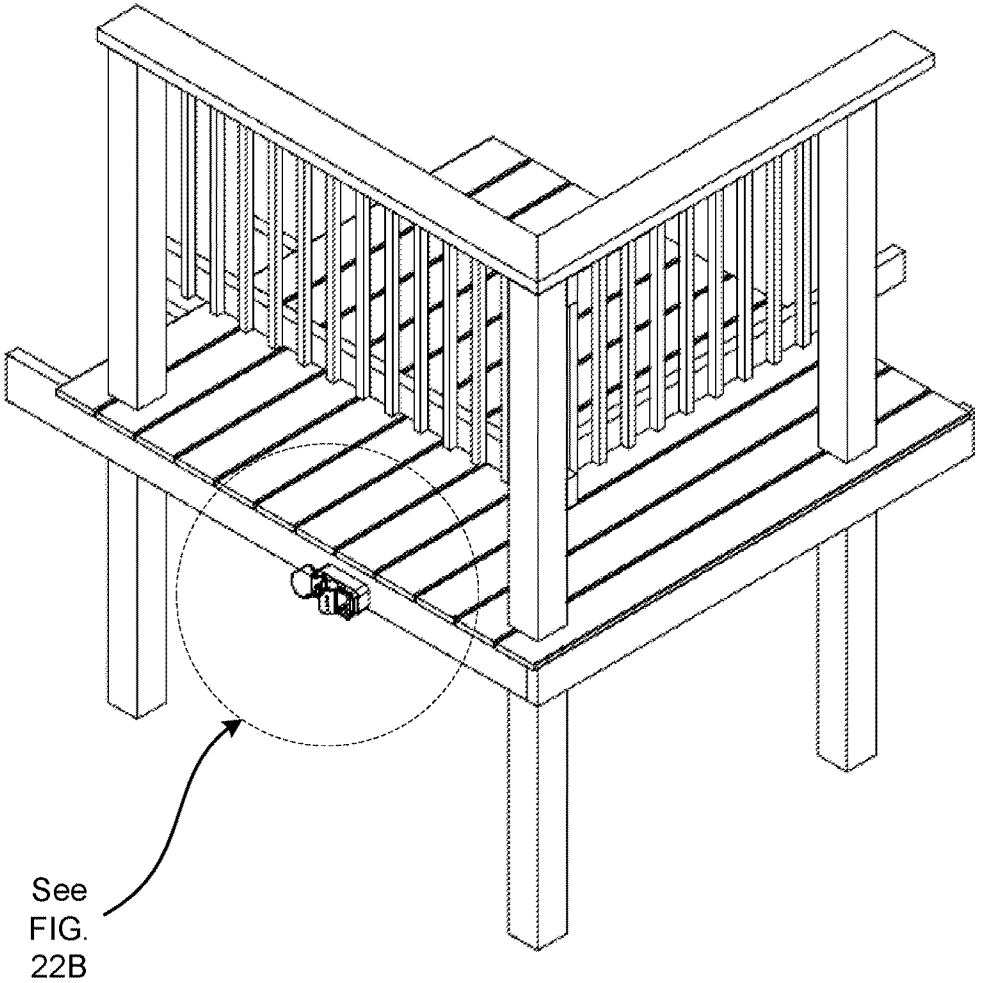
Figure 23B:
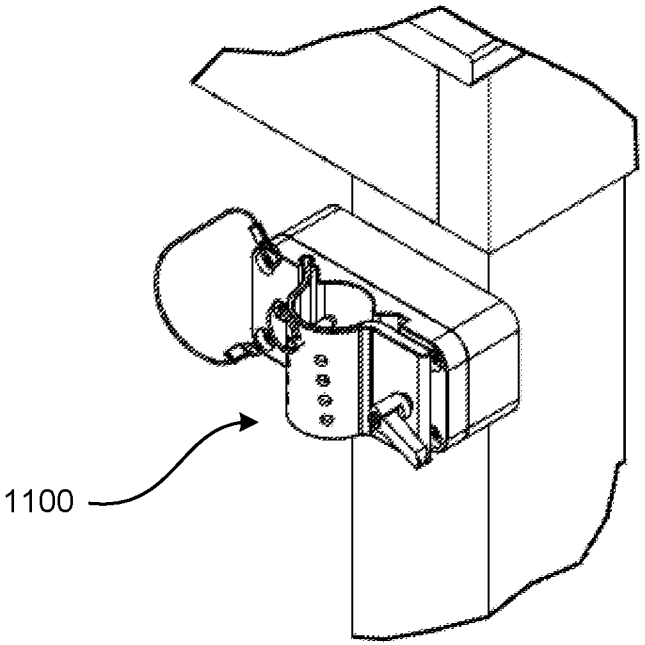
Figure 23A:
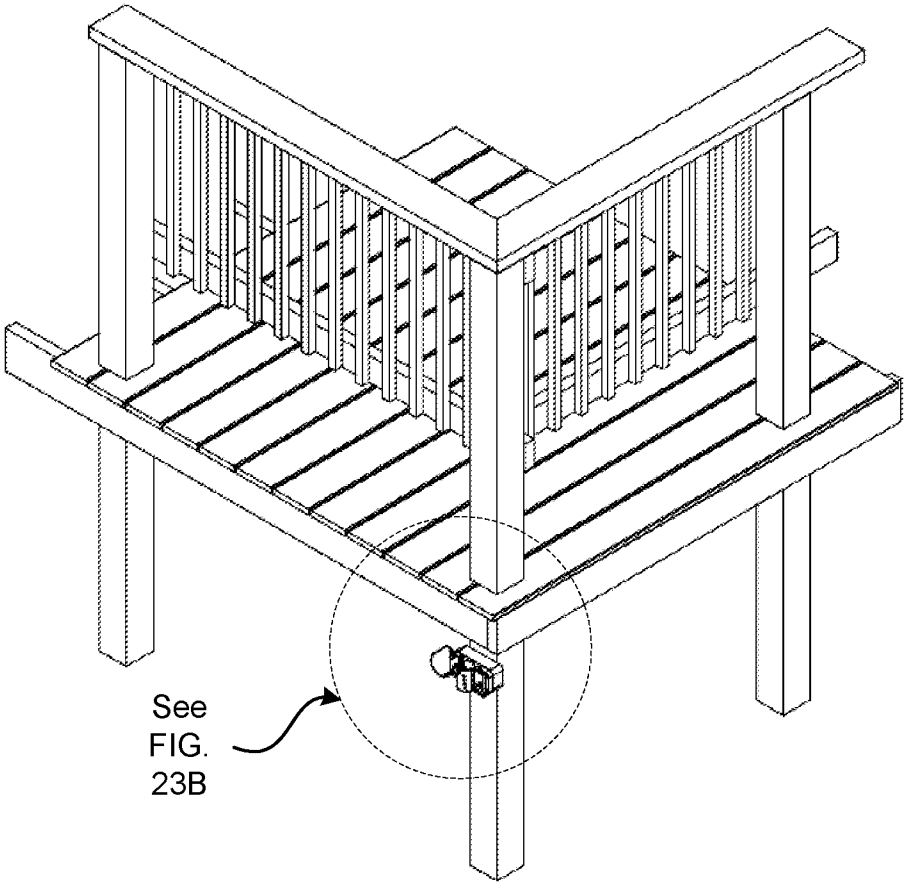

FIG. 17 illustrates another embodiment illustrating a shallow water anchor pole 800 coupled to an assembly arm 808. The anchor pole 800 may be inserted into the ground or bottom of the sandbar, and coupled to the assembly arm 808. The assembly arm 808 may be coupled to an undermount assembly to hold accessories above the water level, as described in various embodiments herein.

FIGS. 18A, 18B, 18C, 19A, and 19B illustrate another embodiment of a clamping system 900, which may be coupled to an exemplar ski-tow bar 984. The clamping system 900 includes the same features as clamping system 100 shown in FIG. 1-12. The clamping system 900 is configured to retain a vertical mounting member 984. The clamping system 900 may include a support member 986 for providing support for the vertical mounting member 984. A mounting spacer 985 may be provided to couple the clamping system 900 to the curved tubing of the ski tow bar. The mounting spacer 985 may be adapted to mount to various ski-tow bar designs, and sizing the mounting spacer 985 for use with ski-tow bars of varying dimensions will be evident to those skilled in the art and may be made without departing from the spirit and scope of the present disclosure. Various accessories may be attached to this vertical mounting member 984, such as canopies, umbrellas, tables, kayaks, paddle boards, floating mats, camera mounts, and flags. In an embodiment, the ski tow bar includes a ski rope holder. In another embodiment, the clamping system 900 may be coupled to ski tow tower.

FIGS. 20A, 20B, 21A, 21B, 22A, 22B, 23A, and 23B illustrate a clamping system 1100 mounted in various mounting locations, such as on a dock or deck. The clamping system 1100 includes the same features as clamping system 100 shown in FIG. 1-12. The clamping system 1100 may be oriented in any direction to couple the mounting block 1102 to a surface. In another embodiment, the clamping system does not include a mounting block, and it can be mounted directly to a surface. The clamping system may be mounted to other structures in the same manner.

Figure 24:
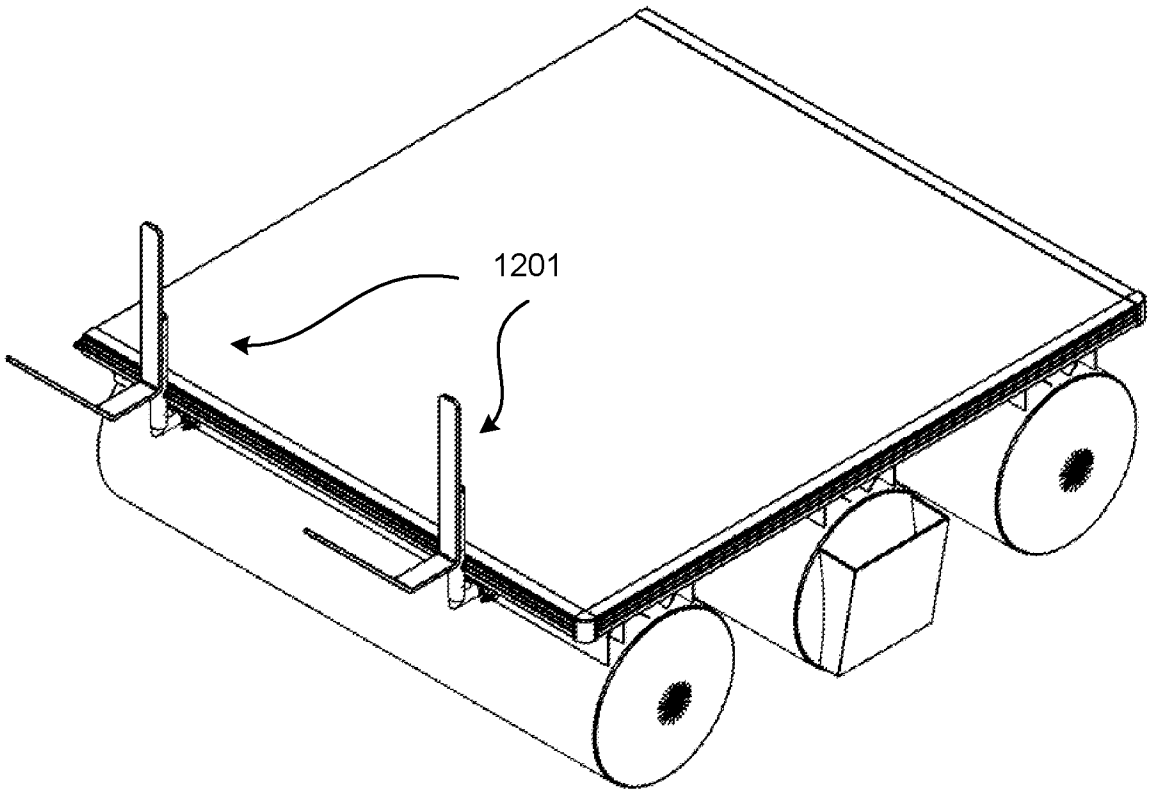
FIG. 24 is a perspective view of an exemplar clamping system and accessory holder, according to an embodiment of the present invention, with an exemplar mounting surface.
Figure 25:
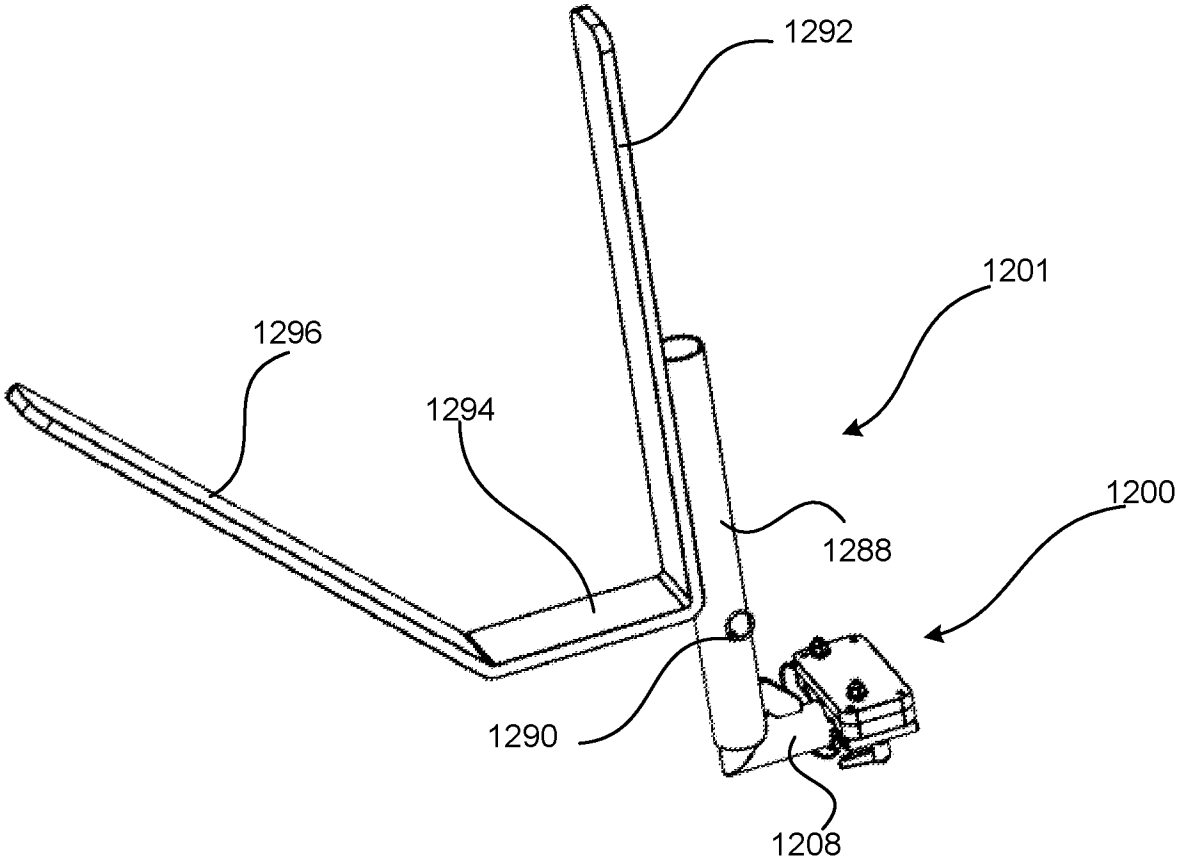
FIG. 25 is a perspective view of a clamping system and exemplar accessory holder, according to an embodiment of the present invention.
Figure 27:
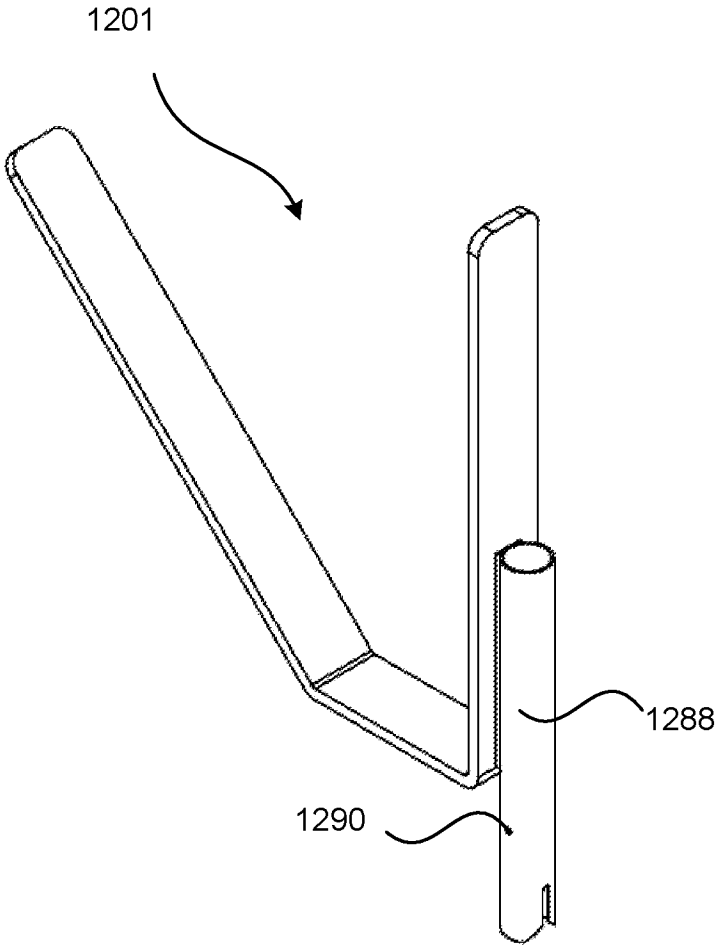
FIG. 27 is a perspective view of the accessory holder of FIG. 25.
Figure 26:
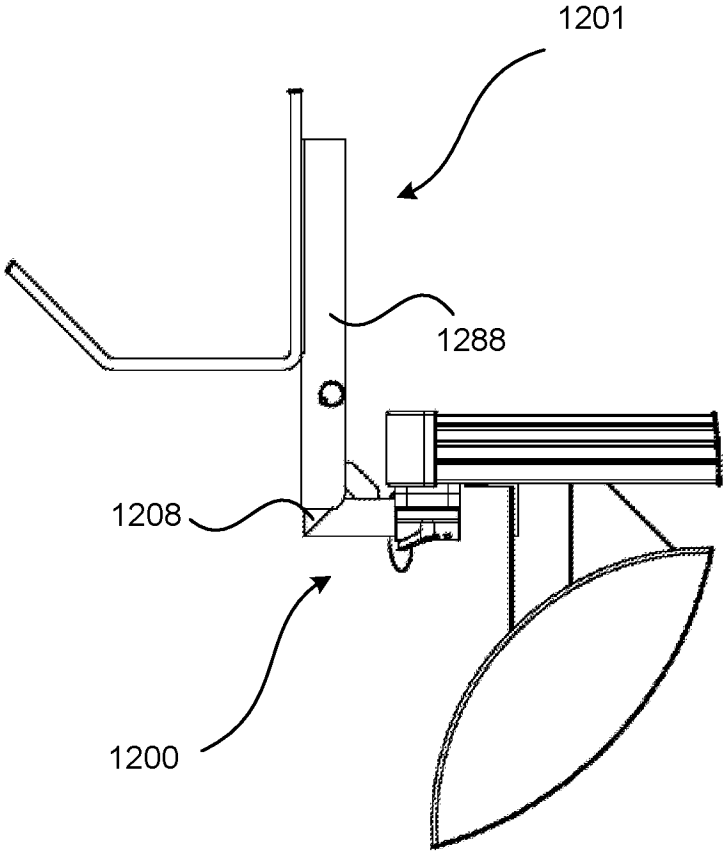
FIG. 26 is a side view of the exemplar clamping system and accessory holder of FIG. 25, according to an embodiment of the present invention, with an exemplar mounting surface.
Figure 28:
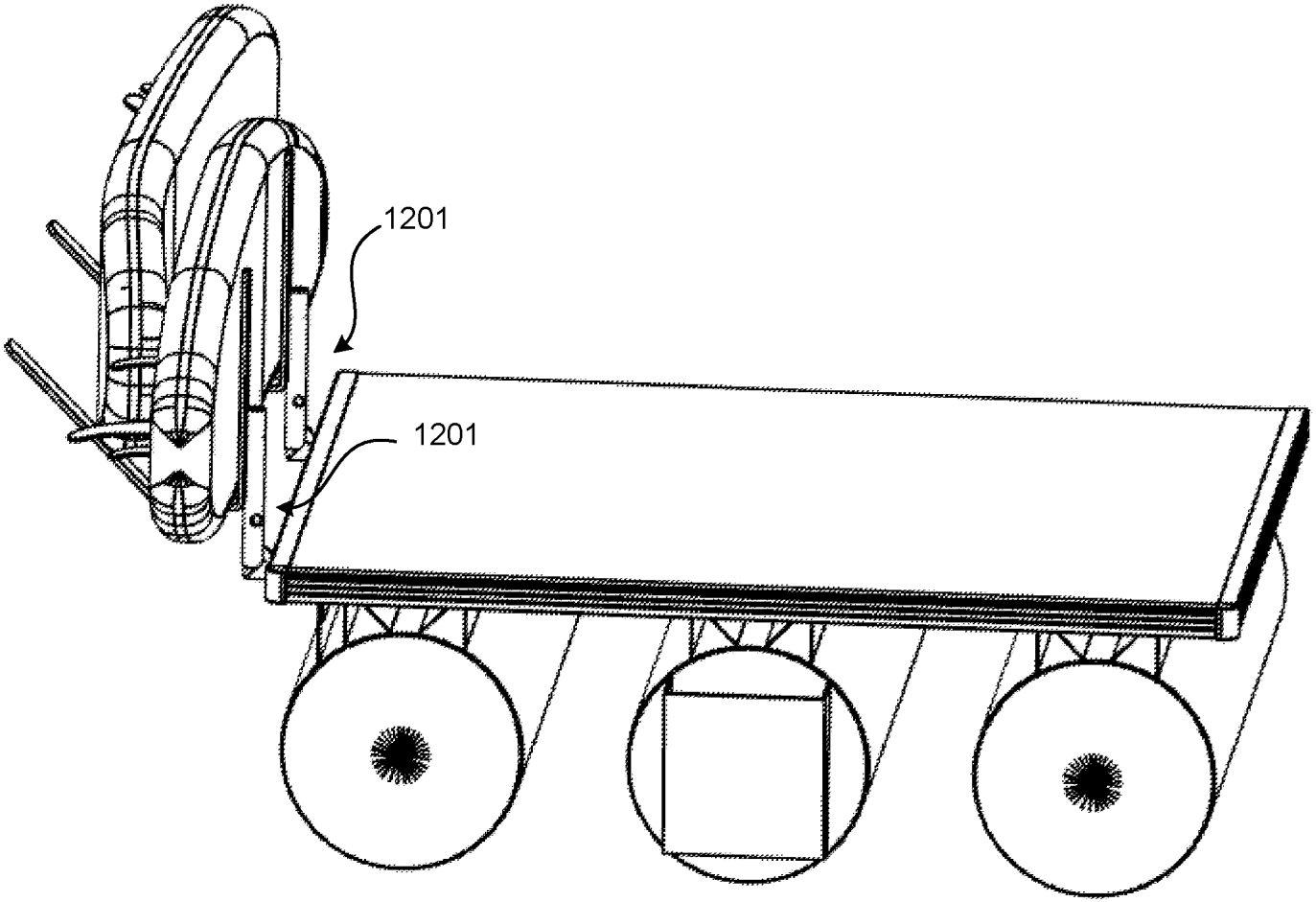
FIG. 28 is a perspective view of an exemplar clamping system and accessory holder, according to an embodiment of the present invention, with an exemplar mounting surface and paddle boards retained in the accessory holder.
Figure 29:
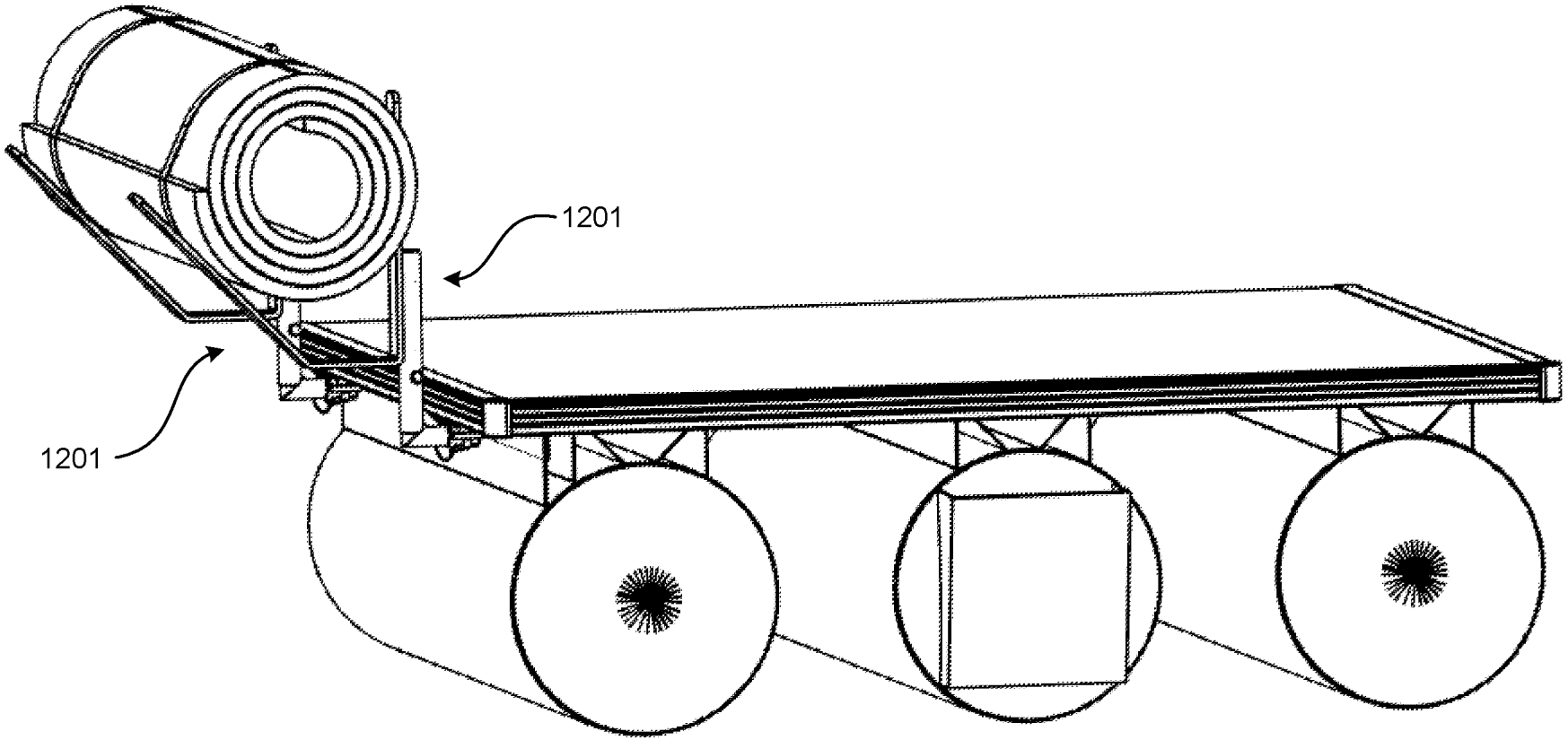
FIG. 29 is a perspective view of an exemplar clamping system and accessory holder, according to an embodiment of the present invention, with an exemplar mounting surface and a floating mat retained in the accessory holder.
Figure 30:
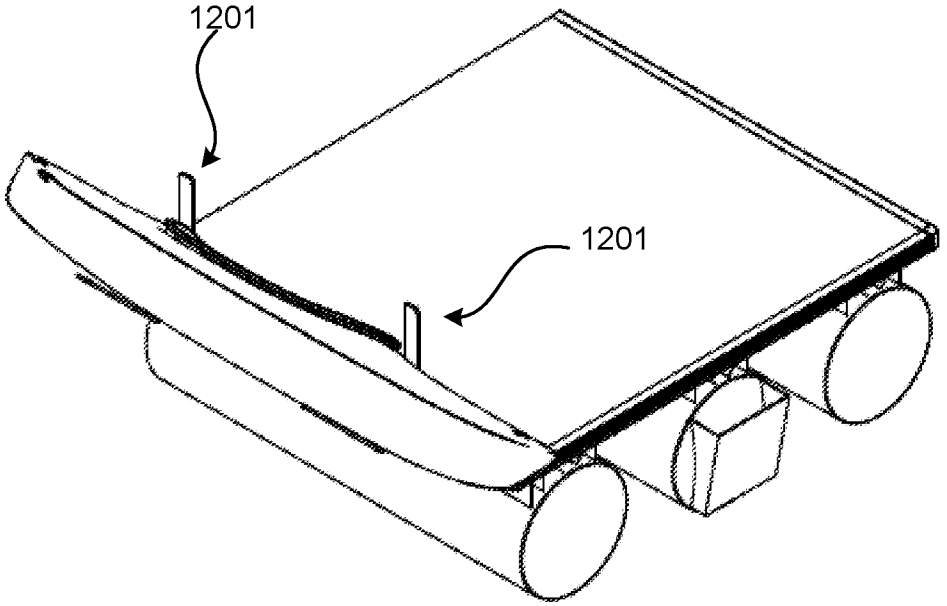
FIG. 30 is a perspective view of an exemplar clamping system and accessory holder, according to an embodiment of the present invention, with an exemplar mounting surface and a kayak retained in the accessory holder.

FIGS. 24, 25, 26 and 27 illustrate a clamping system 1200 and an accessory holder 1201 similar to the clamping systems of previous embodiments. The clamping system 1200 includes the same features as clamping system 100 shown in FIG. 1-12. The assembly arm 1208 may be disposed in an upright position, extending upward from the clamping block. The accessory holder 1201 includes a support tube 1288 that is adapted to fit over the exterior of the assembly arm 1208. The support tube includes holes 1290 for receiving a pin in order to couple the support tube 1288 to the assembly arm 1208, where the assembly arm has holes along its length, and the holes of the assembly arm 1208 and the holes 1290 of the support tube 1288 may be selectively aligned and coupled by a pin, to provide the holder 1201 at the desired height relative to the clamping system 1200. The accessory holder 1201 may be adapted to hold kayaks, paddles boards, and floating mats. In an embodiment, the accessory holder 1201 may include a vertical arm 1292, a horizontal arm 1294, and a diagonal arm 1296. It would be understood that other the dimensions and orientations of the vertical arm 1292, a horizontal arm 1294, and a diagonal arm 1296 may be provided to hold accessories, such as kayaks, paddle boards, and floating mats. In another embodiment, straps may be coupled to the arms of the accessory holder 1201 to secure an accessory to the accessory holder 1201. In the embodiment of FIG. 24, multiple accessory holders 1201 may be coupled to a boat or another mounting surface. FIG. 28-30 illustrate accessory holders 1201 coupled to a clamping system 1200, which is coupled to a pontoon boat. The accessory holders 1201 of FIG. 28-30 are shown retaining various items that may be transported or retained by the accessory holders, including paddle boards, floating mats, and kayaks.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A clamping system adapted to retain an accessory, the clamping system comprising:
   - a clamping block adapted to be coupled to a mounting surface;
   - a clamping member having first and second ends, wherein the first end is pivotably coupled to the clamping block;
   - a fastener disposed on the clamping member proximal to the second end and adapted to engage the clamping block; and
   - an assembly arm,
   - wherein when the fastener is engaged to the clamping block, the clamping block and the clamping member cooperatively define an opening adapted to receive and releasably couple with the assembly arm.

2. The clamping system of claim 1, wherein the assembly arm is coupled to an undermount assembly.

3. The clamping system of claim 1, wherein the clamping member includes a clamping member hole, and the assembly arm includes an assembly arm hole, wherein the clamping member hole and the assembly arm hole are adapted to be axially aligned and receive a pin to retain the assembly arm in a desired position relative to the clamping member.

4. The clamping system of claim 3, wherein the assembly arm is selectively positioned to hold the accessory in a desired position.

5. The clamping system of claim 2, further comprising an entertainment unit accessory coupled to the undermount assembly.

6. The clamping system of claim 5, wherein the entertainment unit accessory includes a grill.

7. The clamping system of claim 5, wherein the entertainment unit accessory includes a table.

8. The clamping system of claim 1, wherein mounting block is adapted to couple to a cross brace of a pontoon boat.

9. The clamping system of claim 1, further comprising a mounting block adapted to couple to a deck of a pontoon boat, wherein the clamping block is coupled to the mounting block.

10. The clamping system of claim 1, wherein clamping block is adapted to couple to a dock.

11. The clamping system of claim 1, wherein the assembly arm is adapted to couple to an anchor pole.

12. The clamping system of claim 1, wherein clamping block is adapted to couple to a ski-tow bar, ski-tow pylon, or ski-tow tower.

13. The clamping system of claim 1, wherein the clamping block includes a ridge that restricts movement of the assembly arm in the substantially cylindrical opening.

14. A clamping system for releasably coupling an accessory to a pontoon boat having a cross brace, the clamping system comprising:

a clamping block adapted to couple to the cross brace;

a clamping member pivotably coupled to the mounting block;

a clamping member hole disposed in the clamping member;

an assembly arm having a first end with an assembly arm hole and a second end;

a support member coupled to the second end; and a pin engaged with the clamping member and assembly arm holes, wherein the first end of the arm is releasably coupled in an opening cooperatively defined by the clamping block and clamping member.

15. The clamping system of claim 14, wherein the clamping member hole is adapted to secure the arm in a desired position relative to the clamping block.

16. The clamping system of claim 14, further comprising an entertainment unit accessory coupled to the support member.

17. The clamping system of claim 14, further comprising a mounting block adapted to couple to the cross brace, wherein the clamping block is coupled to the mounting block.

18. The clamping system of claim 14, further comprising an accessory holder coupled to the support member.

* * * * *